US007900683B2

(12) United States Patent
DeCola

(10) Patent No.: US 7,900,683 B2
(45) Date of Patent: Mar. 8, 2011

(54) SYSTEMS FOR BRACING GARAGE DOORS AGAINST HURRICANE FORCE WINDS

(76) Inventor: Salvatore Michael DeCola, Viera, FL (US)

( * ) Notice: Subject to any disclaimer, the term of this patent is extended or adjusted under 35 U.S.C. 154(b) by 238 days.

(21) Appl. No.: 12/107,169

(22) Filed: Apr. 22, 2008

(65) Prior Publication Data

US 2009/0183841 A1 Jul. 23, 2009

Related U.S. Application Data

(63) Continuation-in-part of application No. 12/016,424, filed on Jan. 18, 2008.

(51) Int. Cl.
*E05D 15/26* (2006.01)

(52) U.S. Cl. ..... 160/264; 160/209

(58) Field of Classification Search ..... 160/209, 160/133, 201, 264, 44; 52/127.2, 167.3
See application file for complete search history.

(56) References Cited

U.S. PATENT DOCUMENTS

| | | | | | |
|---|---|---|---|---|---|
| 2,783,508 | A * | 3/1957 | Keating et al. | 49/466 |
| 2,932,262 | A * | 4/1960 | Keating et al. | 105/355 |
| 3,265,118 | A * | 8/1966 | Smith | 160/209 |
| 3,332,185 | A * | 7/1967 | Adams | 52/287.1 |
| 3,424,223 | A * | 1/1969 | Rosenblatt | 160/209 |
| 3,443,625 | A * | 5/1969 | Moser et al. | 160/181 |
| 3,732,913 | A * | 5/1973 | Wrono | 160/133 |
| 3,853,166 | A * | 12/1974 | Wrono | 160/133 |
| 4,085,788 | A * | 4/1978 | Bernardo | 160/133 |
| 5,383,509 | A * | 1/1995 | Gaffney et al. | 160/209 |
| 5,445,207 | A * | 8/1995 | Romanelli et al. | 160/209 |
| 5,620,038 | A | 4/1997 | DeCola et al. | 160/209 |
| 5,706,877 | A * | 1/1998 | Grisham et al. | 160/201 |
| 5,732,758 | A * | 3/1998 | Marko | 160/201 |
| 5,819,834 | A * | 10/1998 | Wedekind | 160/209 |
| 5,964,269 | A | 10/1999 | DeCola | 160/209 |
| 6,082,431 | A | 7/2000 | DeCola | 160/209 |
| 6,385,916 | B1 * | 5/2002 | Marko | 52/127.2 |
| 6,776,210 | B2 * | 8/2004 | Wells | 160/209 |
| 6,796,361 | B1 * | 9/2004 | Campbell et al. | 160/209 |
| 6,994,144 | B2 * | 2/2006 | Fletcher | 160/209 |
| 2007/0215294 | A1 * | 9/2007 | Barrow | 160/209 |

* cited by examiner

*Primary Examiner* — David Purol
(74) *Attorney, Agent, or Firm* — Allen, Dyer, Doppelt, Milbrath & Gilchrist, P.A. Attorneys at Law

(57) ABSTRACT

Apparatus and techniques for bracing roll down doors of a building against severe winds and against burglary use a vertical bar mounted in a quick release fashion to a plate mounted to the floor by the door and a mounting bracket, mounted to the building, which receives a bracket mounted to the vertical bar which slides into the bracket. The equipment can be provided in a kit form for easy installation by a home-owner, authorized dealer or contractor. The apparatus can be quickly and easily installed for security or when a threat of severe wind is anticipated and easily removed when the threat has passed.

35 Claims, 32 Drawing Sheets

SYSTEMS FOR BRACING GARAGE DOORS AGAINST HURRICANE FORCE WINDS

CROSS-REFERENCE TO RELATED APPLICATION

The present application is a Continuation-In-Part application of U.S. patent application Ser. No. 12/016,424 filed Jan. 18, 2008, entitled: "Improved Systems For Bracing Garage Doors Against Hurricane Force Winds" by Salvatore Michael DeCola, the disclosure of which is incorporated herein.

FIELD OF THE INVENTION

The present invention relates in general to garage door systems, and is particularly directed to a door bracing system made of grooved telescoping column members, that are attachable to a garage door and to the structure of the garage building proper, so as to reinforce and anchor a multi-paneled garage door against high velocity winds and against intrusive using instruments.

BACKGROUND OF THE INVENTION

A typical multi-panel residential garage door is comprised of a plurality of panels (usually made of galvanized steel or fiberglass), which are hinged together at hinge joints. The hinge joints are equipped with side wheels or rollers that ride in a pair of guide tracks that extend along opposite sides of the garage door opening. The guide tracks are usually anchored (e.g., bolted) to wall regions of the garage adjacent to the opening and attached via brackets to the ceiling. The door may be opened and closed either by hand or by way of an automated garage door translation device, such as may be mounted to the ceiling and attached to the topmost one of the door panels.

As described in DeCola et al, U.S. Pat. No. 5,620,038, entitled: "System for Bracing Garage Door Against Hurricane Force Winds", also described in DeCola, U.S. Pat. No. 5,964,269, entitled: "System of Telescoping Longitudinally Grooved Door-Stiffening Columns For Bracing Garage Door Against Hurricane Force Winds", and as described in DeCola, U.S. Pat. No. 6,082,431, entitled: "System of Telescoping Longitudinally Grooved Door-Stiffening Columns For Bracing Garage Door Against Hurricane Force Winds," (the disclosure of each of which is incorporated herein by reference in its entirety), when a multi-panel garage door is exposed to high velocity winds of a violent storm, such as a hurricane, the door panels have a tendency to separate from the guide tracks as a result of continued flexing of the panels and fatigue of the tracks themselves. This repeated flexing causes the side wheels to become detached from the tracks so that the ends of panels become warped, allowing wind to enter the garage and literally rip or 'peel' the door away from the garage door opening. Once the garage and adjacent structure has been blown out, the ceiling of the garage and adjacent structure are no longer protected from the extremely high velocity winds of the storm, and it is simply a matter of time before the roof blows off, causing the entire structure to be destroyed.

Follow-up investigation to the widespread damage to residential buildings in south Florida by Hurricane Andrew in 1992 has revealed that had garage doors been reinforced against such separation from the guide tracks, and not blown out, the full force of the hurricane would not have been able to enter many of the destroyed houses. As a result of this investigation, homebuilders in coastal areas of south Florida are required to provide some form of hurricane reinforcement for their garage doors. Recommendations of how to accomplish this have usually involved the installation of (metal or wooden) girts that extend horizontally across each panel. Such girts are intended to stiffen the panels and prevent their oscillatory motion that leads to the destructive separation from the tracks.

Unfortunately, such stiffening panels add considerable weight to the door, requiring adjustments of both the lifting coil spring and of the drive of the automated garage door translation mechanism. Moreover, even with such adjustment, the substantial weight of the girts, for which neither the door nor the automated translation mechanisms were originally designed, leads to further wear and tear of the automatic garage door opener. Yet, even with such stiffeners, the fundamental problem they are intended to solve is not remedied, since they do not prevent torquing of the panels at the point of attachment of the door to the tracks, and do not effectively relieve the wind load placed on the entire garage door opening. The girts are unable to prevent torquing since they extend horizontally—making them parallel to joint lines between panels. Such an orientation provides axes of rotation, about which the panels are torqued when subjected to high velocity winds. The girts provide neither reinforcement nor a separation barrier along the lengths of the tracks, nor do they make the door a wind-loadable door.

Advantageously, the door-bracing system described in the above-reference patents remedies these shortcomings, by means of a door bracing system that contains a plurality of door-stiffening column members that are installed between associated upper mounting brackets above the garage opening and lower mounting brackets affixed to the garage floor. The door bracing system also includes deflection brackets which attach the door panel hinge joints to the column members, so that the entire vertical extent of the garage door is effectively braced against high velocity winds, and thereby prevented from separating along the guide tracks.

Problems of the Prior Art

Although the inventions described in U.S. Pat. Nos. 5,620,038; 5,964,269 and 6,082,431 represented a significant advancement over the prior art, each of those patents required that the vertical supports mount to the building housing the garage door above the top of the garage door opening. This made it less convenient to use with a roll type garage door without extraordinary efforts. Further, each of those patents require the replacement of hinge pins with longer ones used to connect the panels of the garage door to the vertical supports. Further, there is a lack of flexibility of location in positioning the vertical supports. Further, the top connection of the vertical supports were bolted to the building, which made them difficult to remove once the threat of a hurricane passed. Thus, installation and removal is more difficult.

Further, when a vertical support was placed in between the tracks for the garage door, there was not a positive connection which would protect against both positive and negative air pressure surges. Further, much of the prior art lacked hardware and techniques for securing a garage door that was the only opening into a secured space, such as a commercial storage unit, that is for securing a garage door from the outside.

Finally, the prior art did not allow easy assembly and shipping to a customer in a kit form for do-it-yourself installation.

BRIEF SUMMARY OF THE INVENTION

The invention is directed to an apparatus and techniques for bracing garage doors against hurricane force winds which overcome the problems of the prior art. More specifically, the invention is directed to:

One aspect of the invention relates to an apparatus for bracing a roll down door that provides selective access to an area of a building, which has a vertical support, a floor mount for securing said vertical support to a floor at a point adjacent to a path of said roll down door; a top mount which has a mounting bracket for attachment to the building and a support bracket attached to said vertical support which slideably engages the mounting bracket. Portions of the door's surface are connected to the vertical member to resist both positive and negative pressure.

Another aspect of the invention relates to a method of bracing a roll down door that provides selective access to an area of a building which involves mounting a plate to a floor beneath said roll down door, mounting a mounting bracket to said building, attaching a support bracket to a vertical support, attaching at least one sliding bolt assembly to a vertical support, sliding said support bracket into said mounting bracket; and moving at least one sliding bolt of a sliding bolt assembly into engagement with openings in said plate to prevent the bottom of the vertical member from moving in the plane of the floor.

Another aspect of the invention relates to a method of bracing a roll down door by sliding a support bracket connected to the top of a vertical member into a mounting bracket mounted to said building and moving at least one sliding bolt of a sliding bolt assembly attached to the bottom of said vertical member into engagement with an opening in a floor plate mounted to a floor underneath said roll down door.

Another aspect of the invention relates to a kit for bracing roll down doors of a building, including at least one vertical support, a floor plate for each vertical support, at least one sliding bolt assembly for mounting to each vertical support, a mounting bracket for each vertical support for mounting to a building surface and a support bracket for attachment to each vertical support and for slidably engaging a mounting bracket.

The invention is also directed to a kit for bracing roll down doors of a building from the outside against severe winds, comprising:

a. at least one vertical support;
b. a floor plate for each vertical support;
c. at least one sliding bolt assembly for mounting to each vertical support;
d. a mounting bracket for each vertical support for mounting to a building surface; and
e. a support bracket for attachment to each vertical support and for slidably engaging a mounting bracket.

The invention is also directed to the kit in which the at least one vertical support bar is a telescoping vertical support bar.

The invention is also directed to the kit in which at least on vertical support is of substantially rectangular cross section with at least one T channel extending the length of the vertical support bar.

The kit further comprising at least one bracket for attaching to a door panel and a rotatable hook for rotating into engagement with said bracket and connecting to the vertical support bar.

DETAILED DESCRIPTION OF THE INVENTION

Figure 1A:
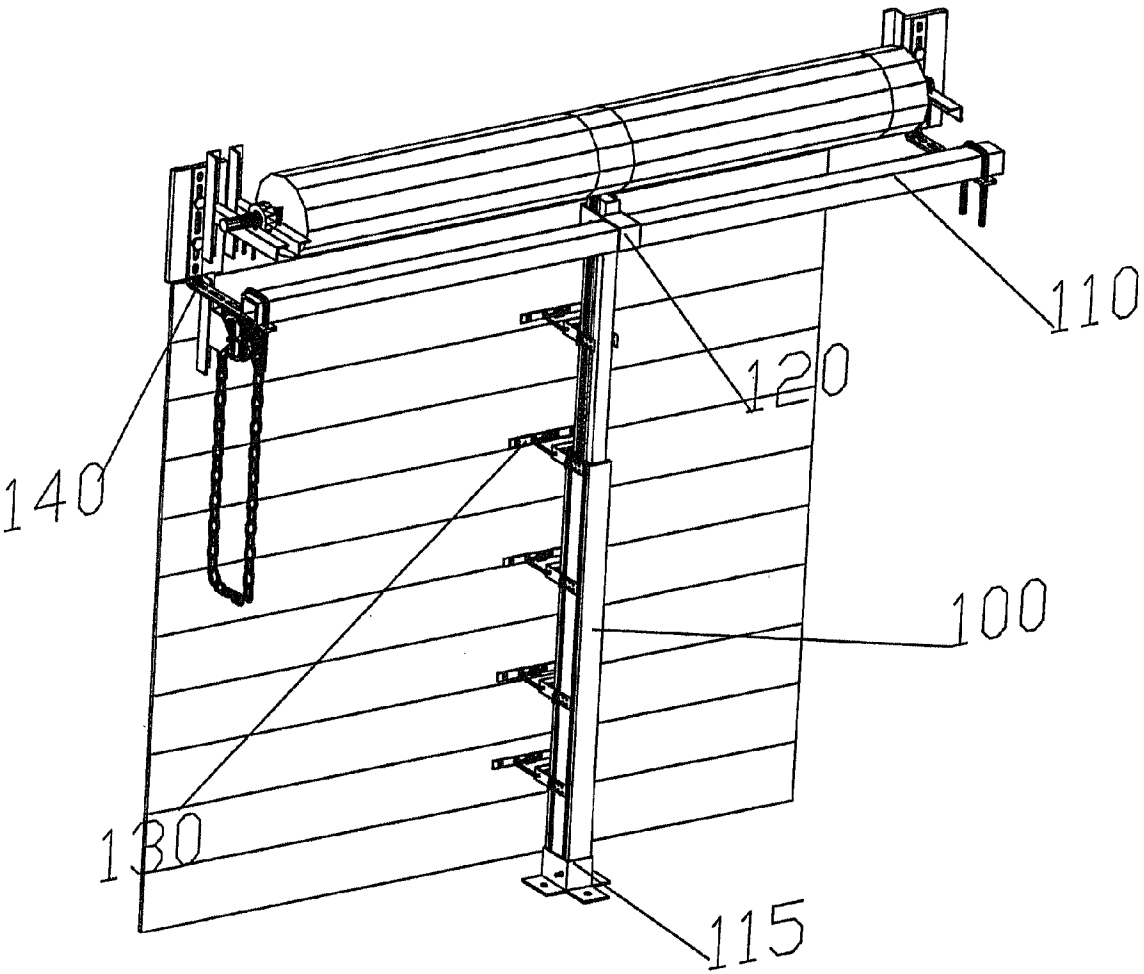
FIGS. 1A, 1B, and 1C are perspective views of a single, double and triple vertical support for respective, single, double and triple wide garage doors in accordance with one aspect of the invention.

FIG. 1A shows a perspective view of a single vertical support for a singlewide garage door in accordance with one aspect of the invention. The telescoping vertical support 100 is mounted to the floor using a mounting bracket 115 in ways that are shown in the prior art. When the vertical support is removed, the mounting bracket 115 can be removed for normal operation during a time when no hurricane is threatened. The vertical support 100 connects to a cross bar 110 using a bracket 120, described more hereinafter. The vertical support is connected to at least one panel of the garage door using bracket 130, as described more hereinafter. The horizontal cross bar 110 is mounted to the wall of the building using one or more brackets as described more hereinafter.

Figure 1B:
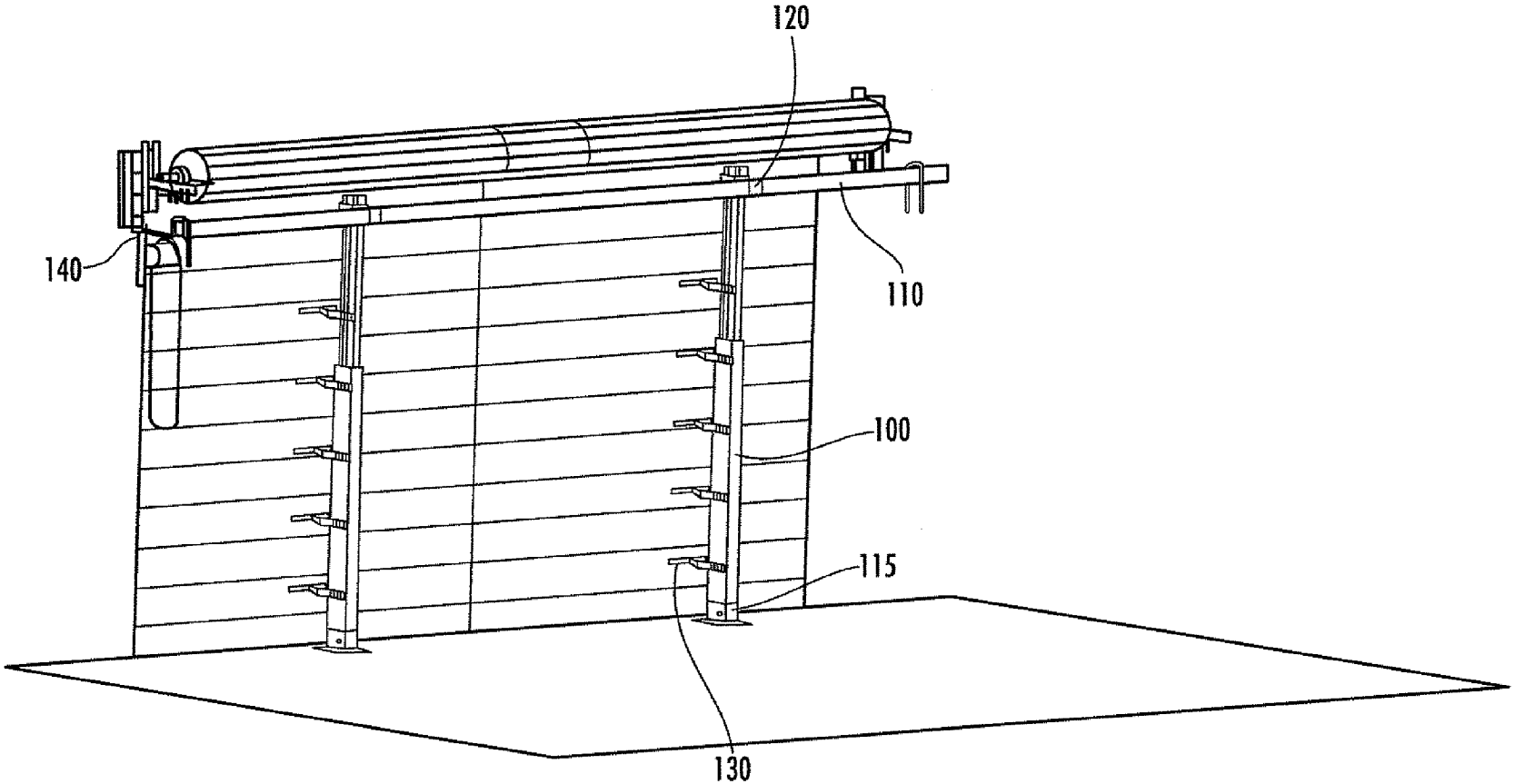
Figure 1C:
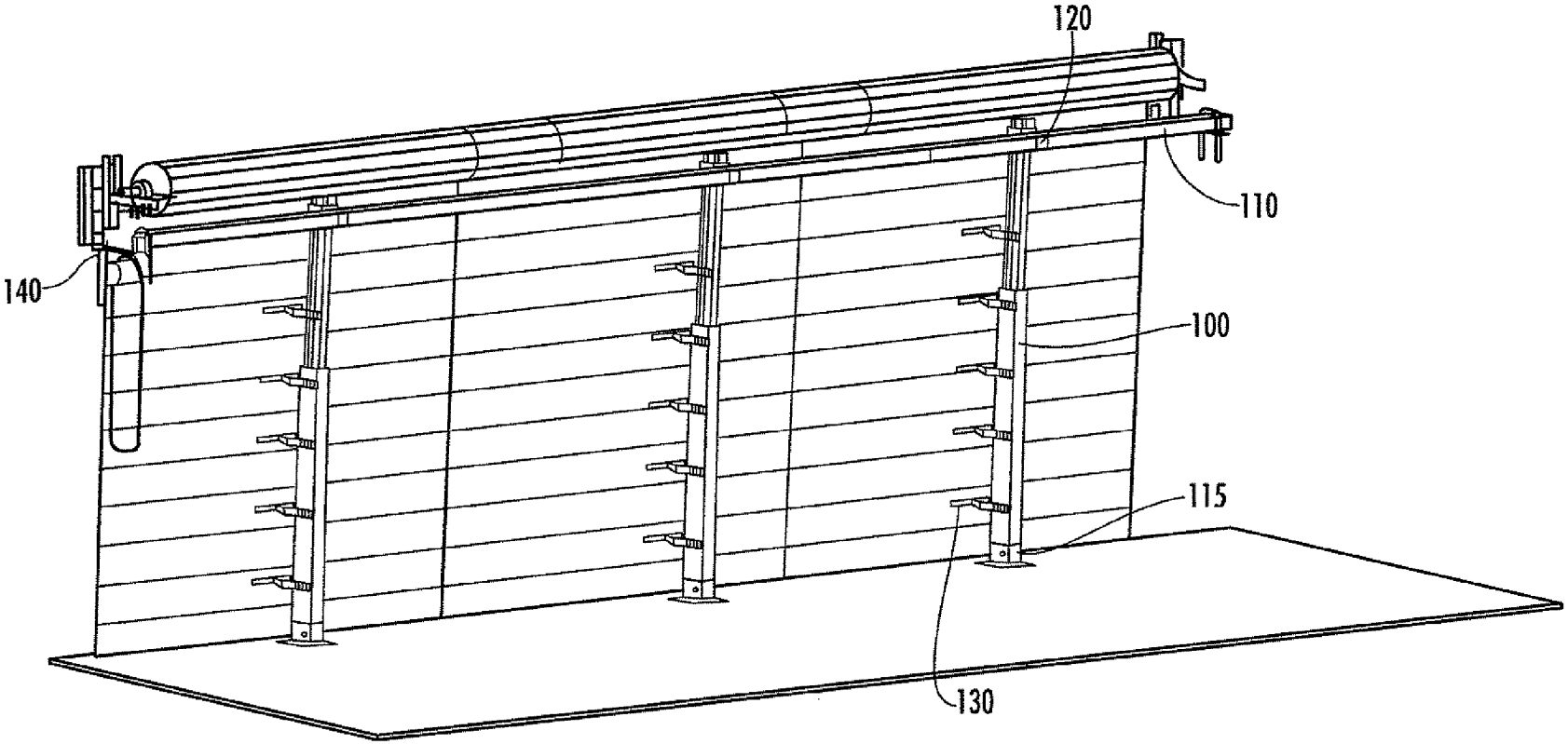

FIGS. 1B and 1C show perspective views of a double and triple vertical support for double and triple wide garage doors in accordance with one aspect of the invention. In each of these figures, the vertical support 100 is replicated two or three times to accommodate the size of the garage doors.

Figure 2:
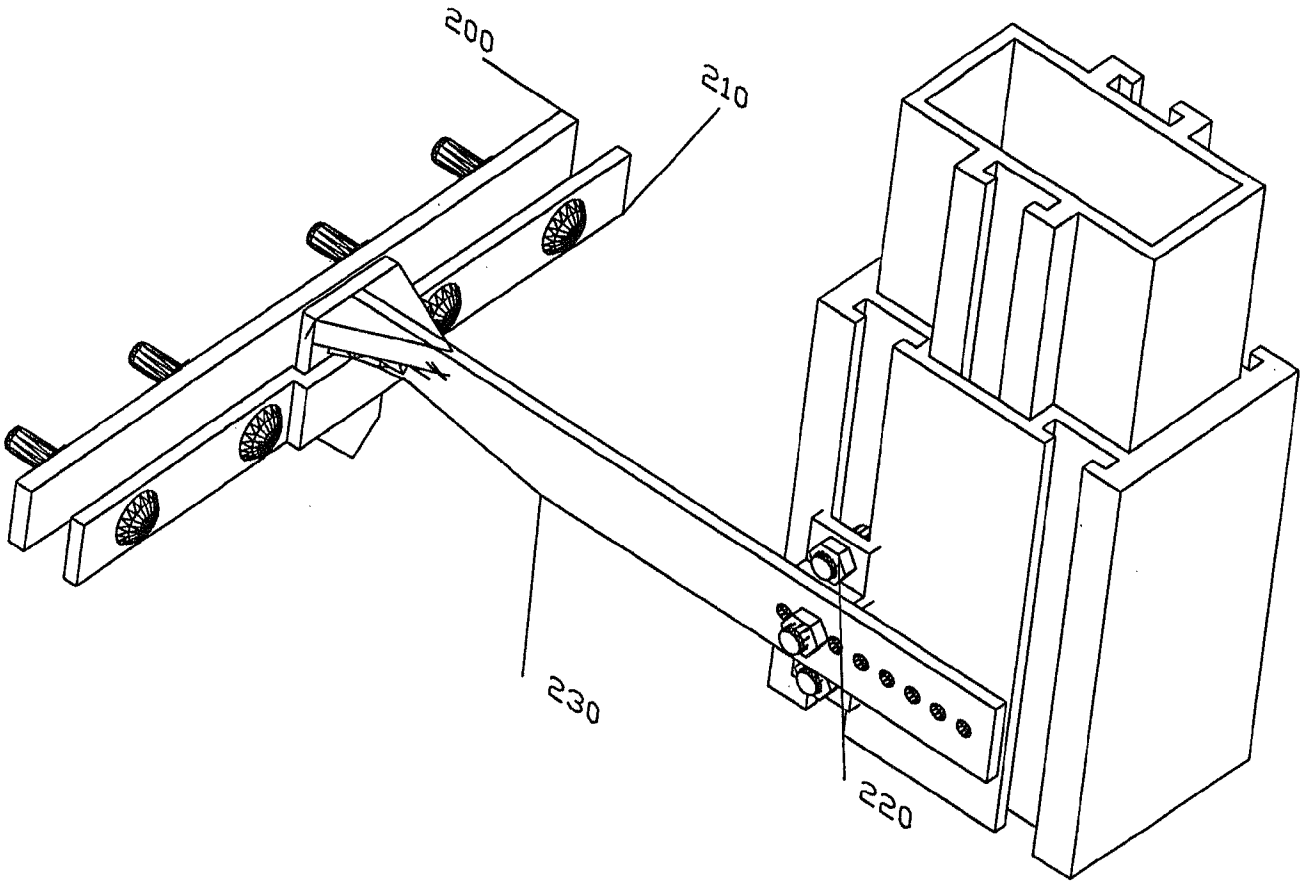
FIG. 2 shows a perspective view of hardware used to attach a telescoping vertical support to the garage door in accordance with one aspect of the invention.

FIG. 2 shows a perspective view of hardware used to attach a telescoping vertical support to the garage door in accordance with one aspect of the invention. Depiction of the thickness of the garage door is not illustrated to permit a view of the mounting of the brackets to the garage door to be visualized more readily. The mounting to the garage door occurs using a rear bracket 200 and a front bracket 210. The two brackets are positioned on opposite sides of a panel thickness for the garage door and are sized so as to permit the panel of the garage door to roll up and be stored in its usual fashion. Bracket 210 has a U channel, described more hereinafter. A channel slide 220 fits into the T channel on the vertical support and can be moved into position and then secured by tightening the nuts associated with the bolt, the bolt head of which rides in the channel. A third bolt, extending from the channel slide is utilized to mount a hook 230, the point of which fits into the U channel of the front bracket 210 of the door mounting brackets.

Figure 3:
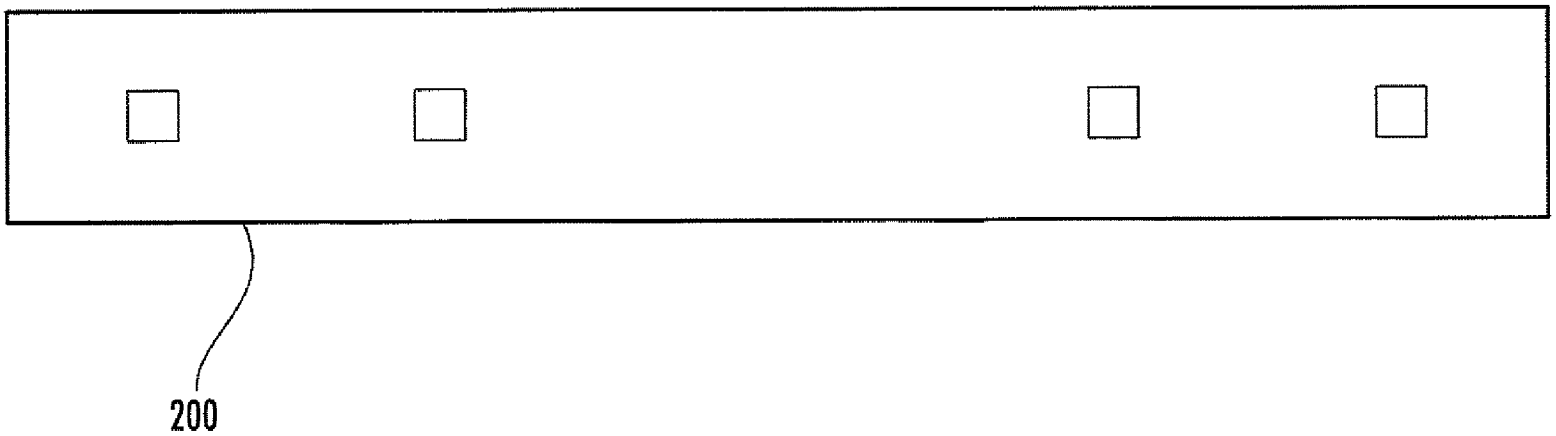
FIG. 3 illustrates a backside piece for attachment to a garage door panel.

FIG. 3 illustrates a rear bracket piece 200 of a door-mounting bracket for attachment to the garage door panel. The material for the bracket is ⅛ GA steel.

Figure 4:
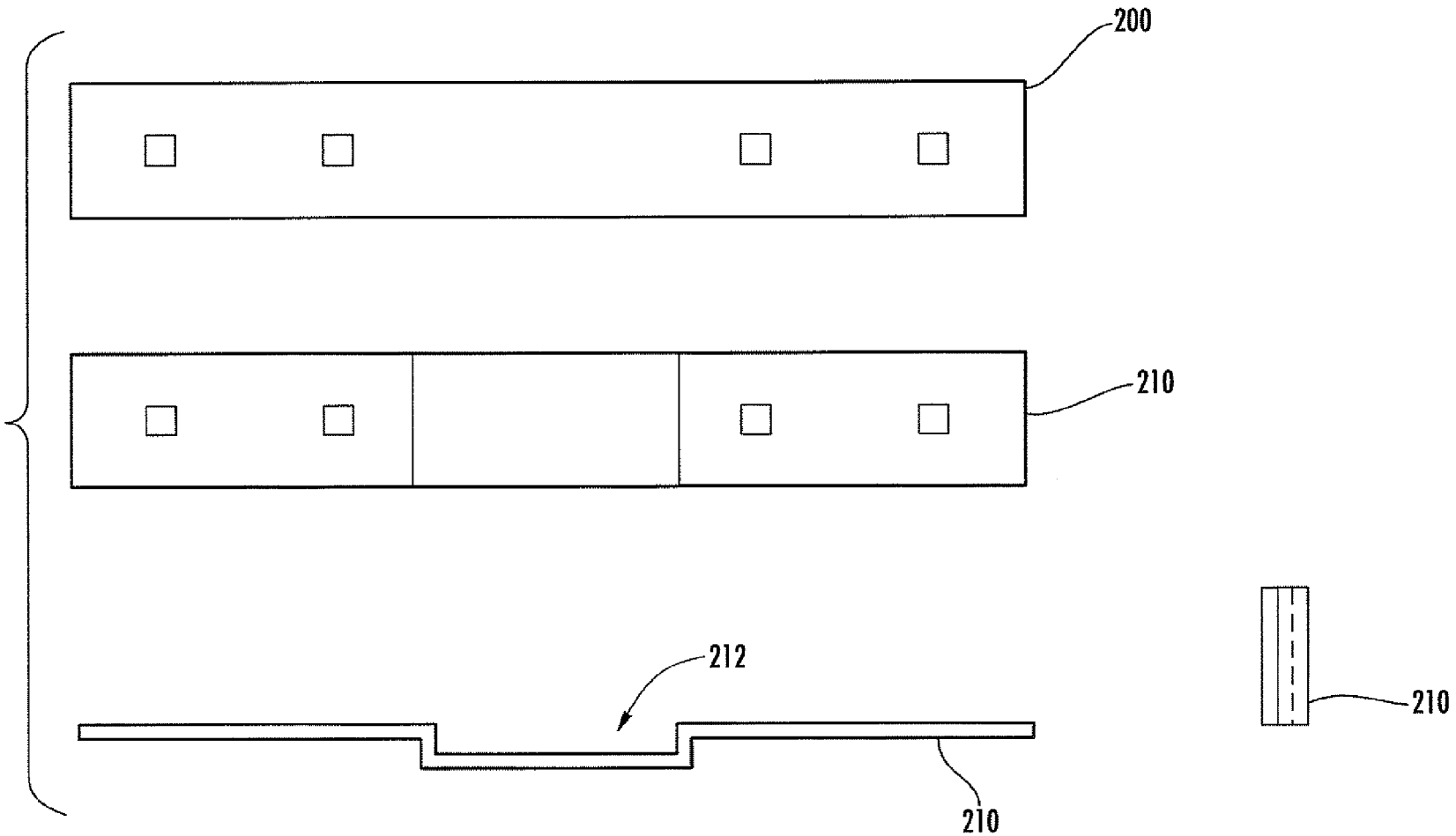
FIG. 4 illustrates a front side piece having a U shaped channel for attachment to a garage door panel.

FIG. 4 illustrates the front bracket 200 having a U shaped channel 212 for attachment to the garage door.

Figure 5:
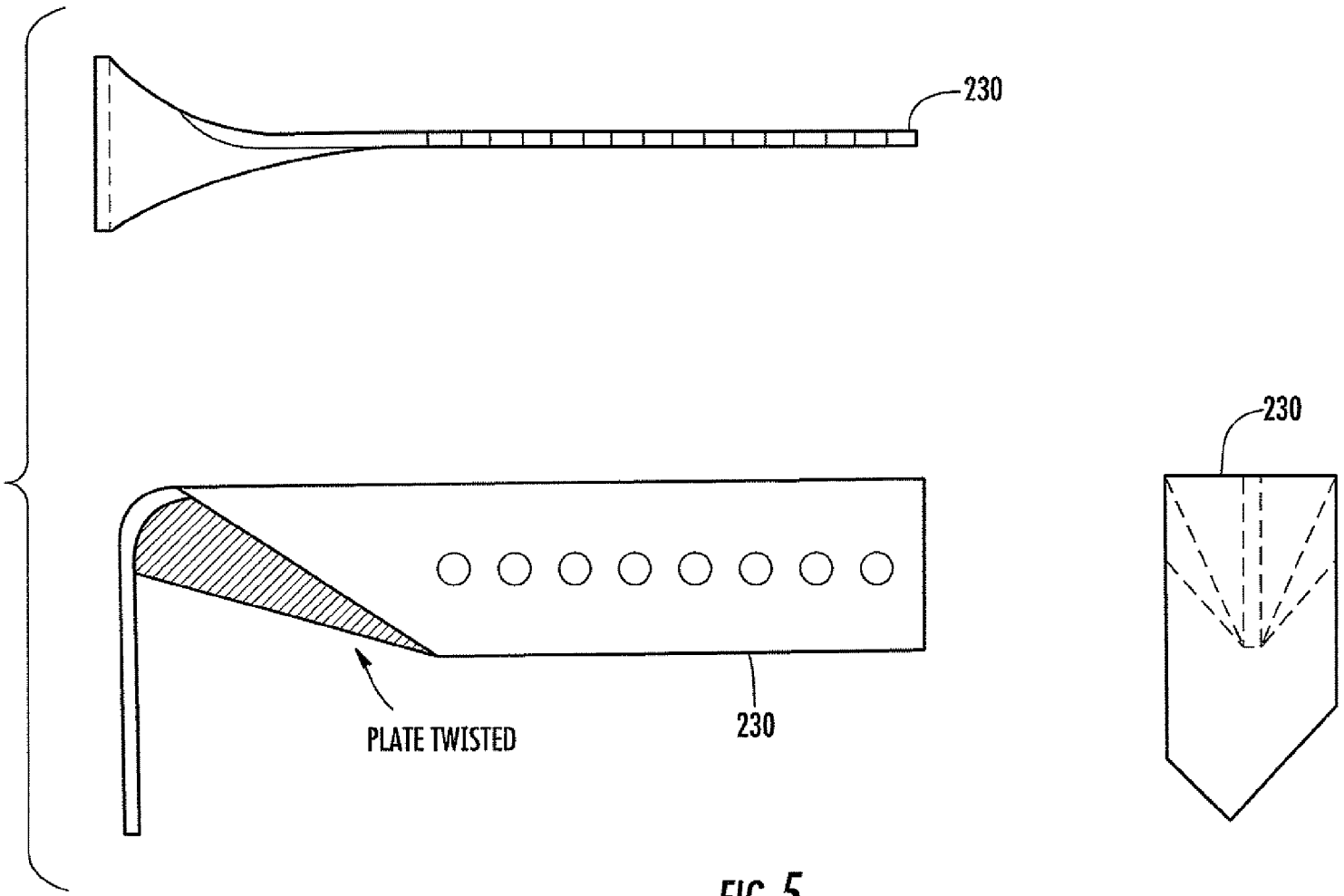
FIG. 5 illustrates a hook piece that rotates to fit into the U shaped channel of FIG. 4 to connect the door to the telescoping vertical support.

FIG. 5 illustrates a hook piece 230 that rotates to fit into the U shaped channel 212 of FIG. 4 to connect the door mounting brackets to the telescoping vertical support 100.

Figure 6:
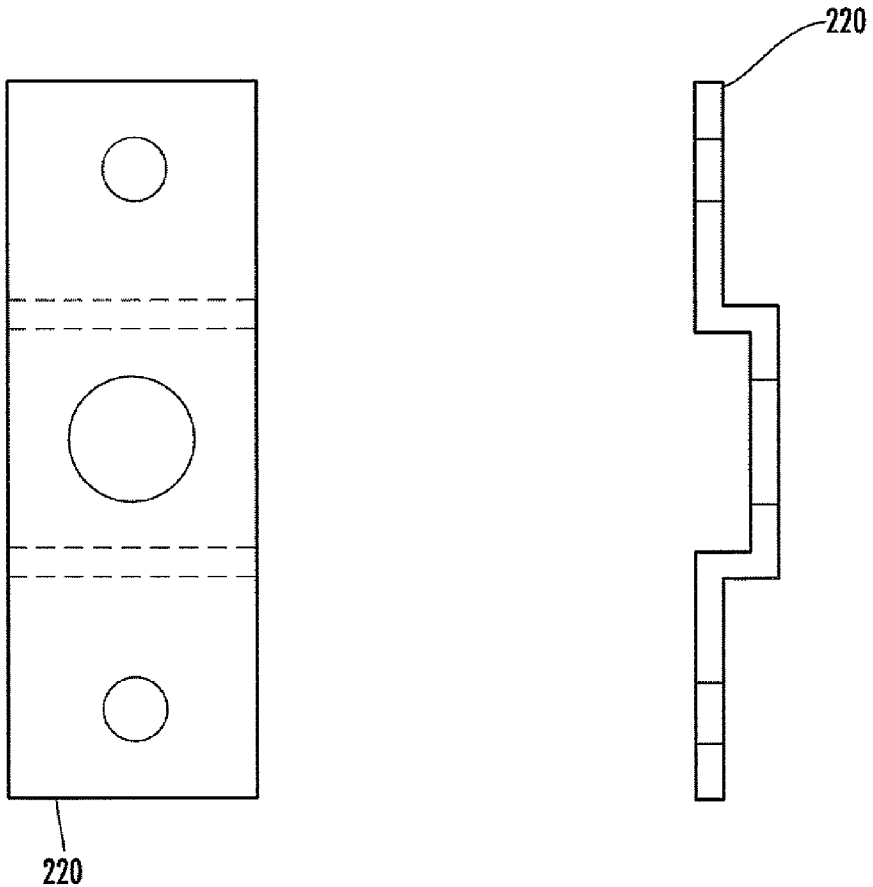
FIG. 6 illustrates a channel slide piece that can be adjusted vertically in a T channel track of a vertical support.

FIG. 6 illustrates the details of the construction of a channel slide piece 220 that can be adjusted vertically in a track of a vertical support 100.

Figure 7:
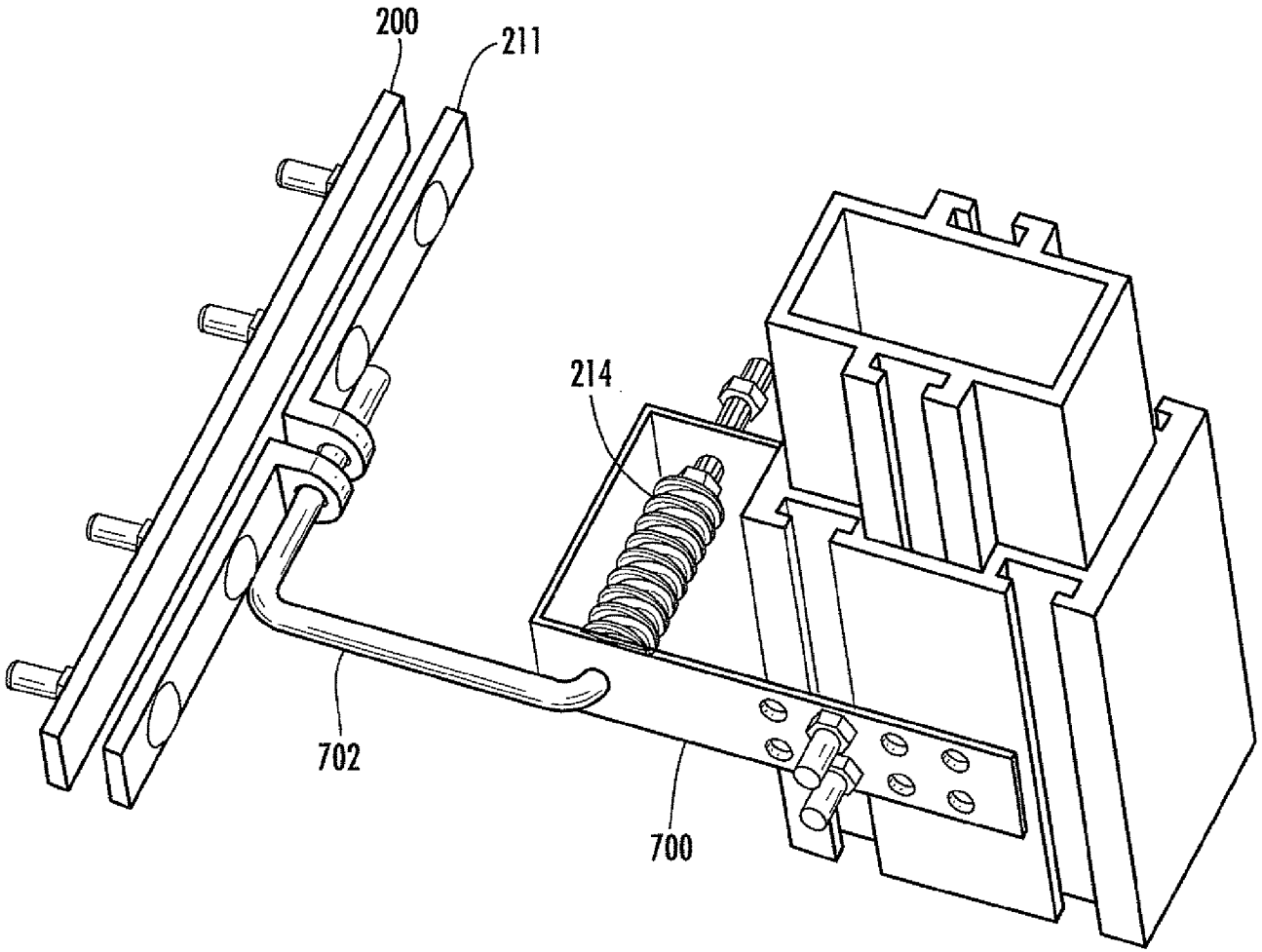
FIG. 7 illustrates an alternative technique for connecting the garage door to the vertical support.

FIG. 7 illustrates an alternative technique for connecting the garage door to the vertical support. In this case, a bracket 700 is mounted to the vertical slide using the bolt heads to guide the bracket positioning of the bracket in the T channel of the vertical support. The bracket 700 is configured to receive and mount a spring-loaded J channel 702 which can be inserted into the holes of the front side door mounting brackets 211 of slightly modified construction shown in FIG. 7. To remove the J channel 702, the channel is pulled to the left until it clears the holes and then it can be released to be held in place by the spring 214 for use when it is installed at a later time. The spring 214 keeps the J channel 702 out of the way when the vertical supports are stored when no hurricane threat is present.

Figure 8:
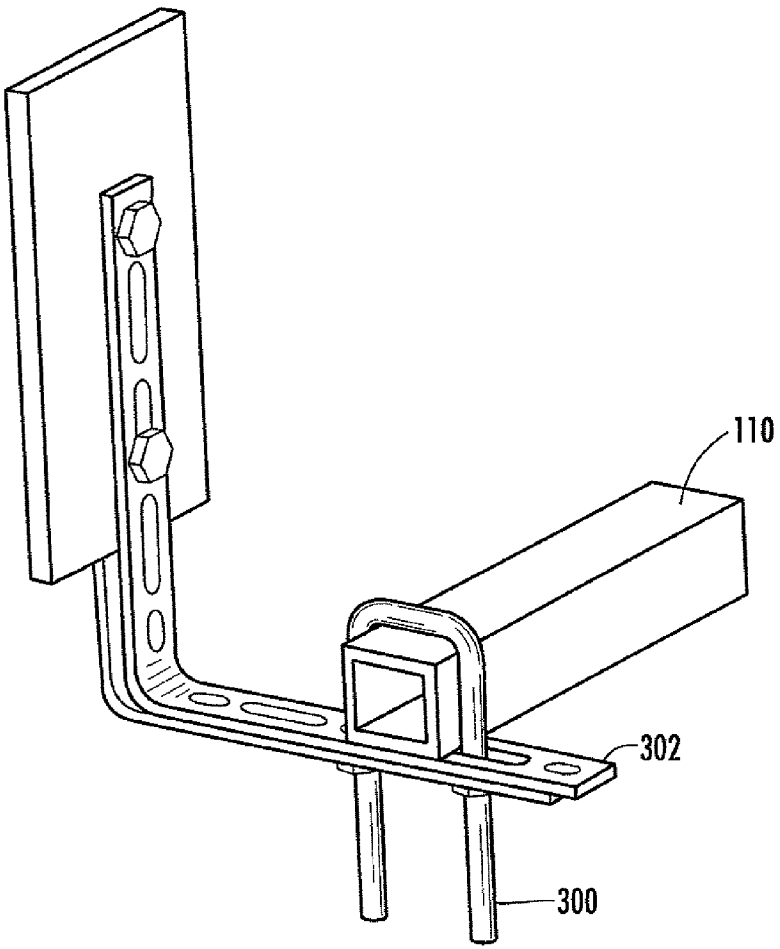
FIG. 8 illustrates a first technique for mounting the horizontal cross bar shown in FIG. 1 to the building.
Figure 9:
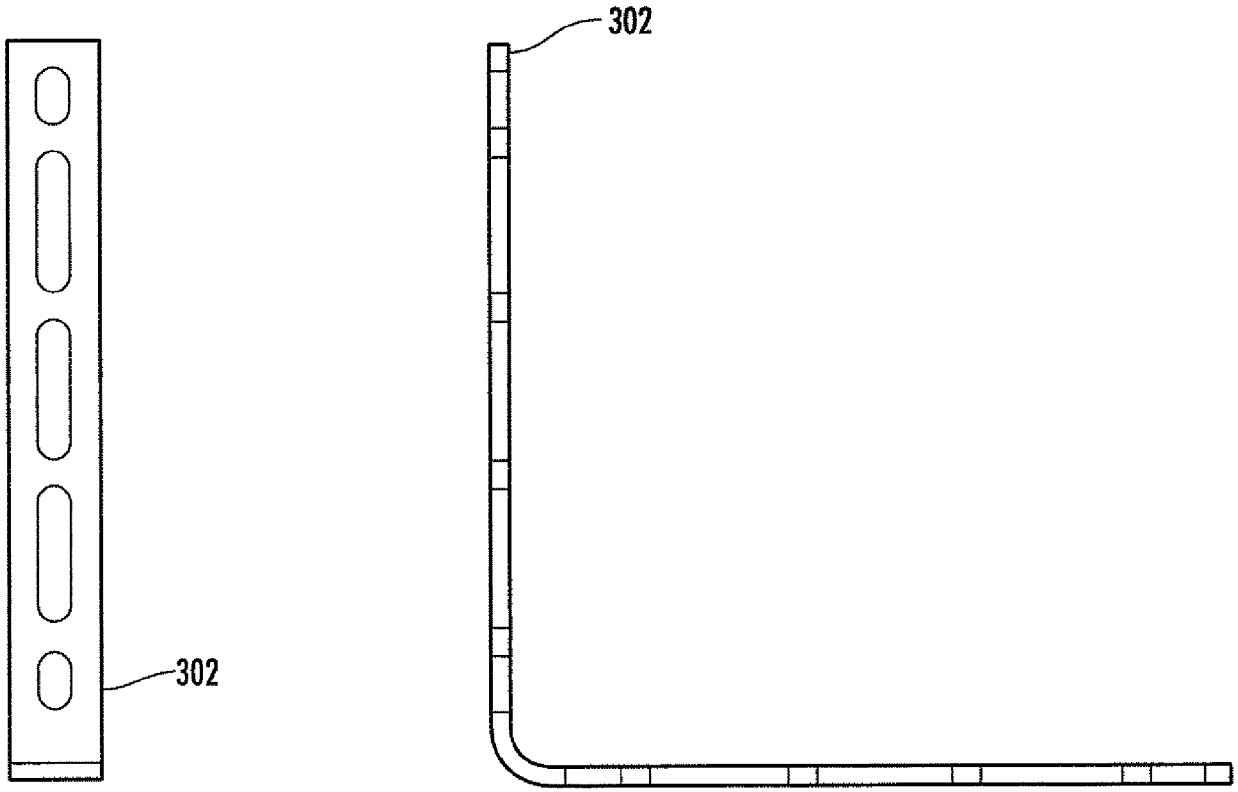
FIG. 9 shows details of the L bracket illustrated in FIG. 8.

FIG. 8 illustrates a first technique for mounting the horizontal cross bar 110 shown in FIG. 1A to the building. As shown, the horizontal cross bar is held in place by a U channel 300 inserted through the lower portion of an L bracket 302, the vertical portion of which is mounted to a wood, concrete or steel plate securely fastened to the building. The details of the L bracket 302 illustrated with FIG. 8 are shown in FIG. 9.

Figure 10:
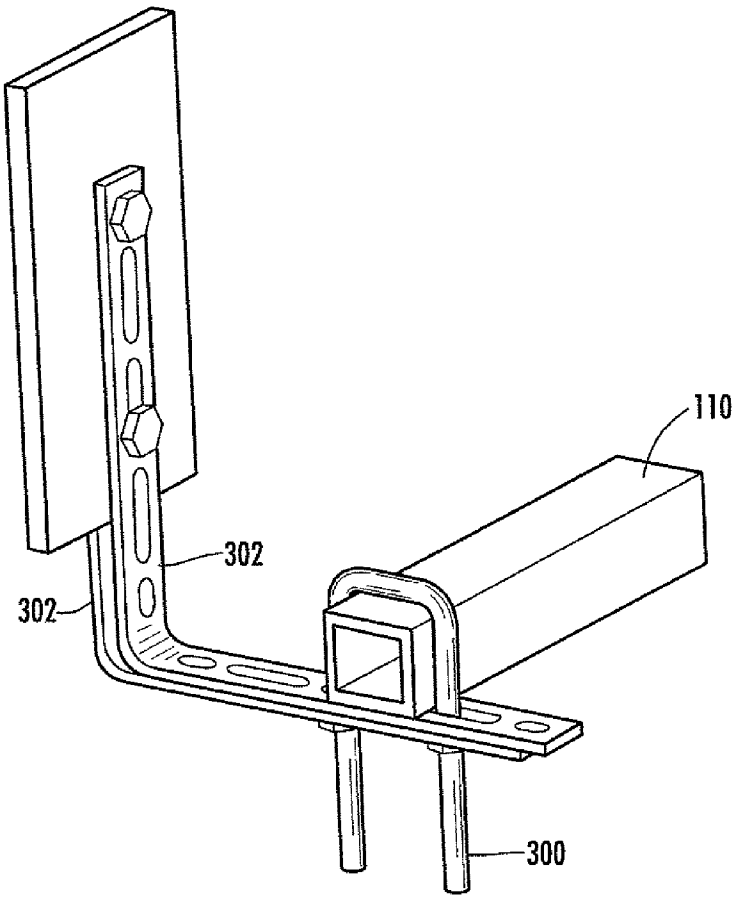
FIG. 10 shows a second technique for mounting the horizontal cross bar to the building.

FIG. 10 shows a second technique for mounting the horizontal cross bar 110 to the building. This technique uses two L brackets 302, one on either side of a plate to provide additional strength.

Figure 11:
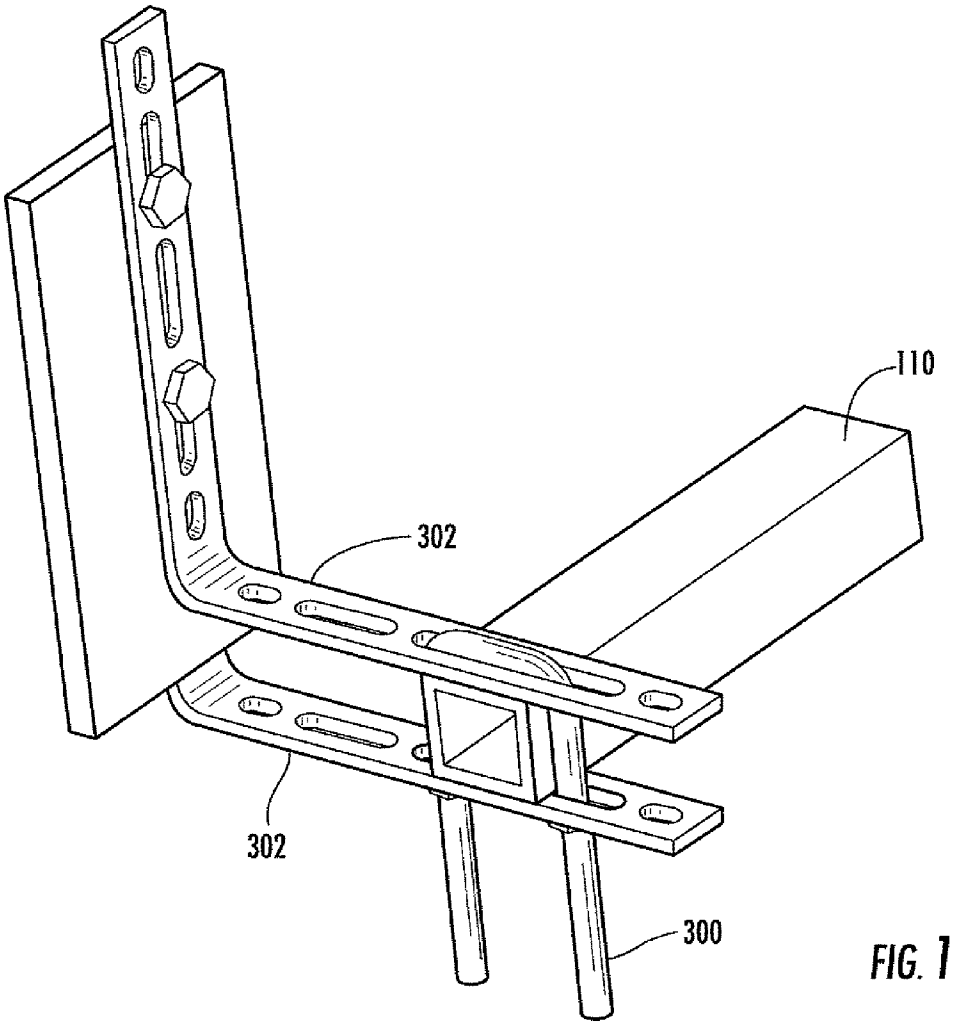
FIG. 11 shows a third technique for mounting the horizontal cross bar to the building.

FIG. 11 shows a third technique for mounting the horizontal cross bar 110 to the building. This technique also utilizes two L brackets 302 with the bottom piece of each L bracket being on opposite sides of the channel cross bar.

Figure 12:
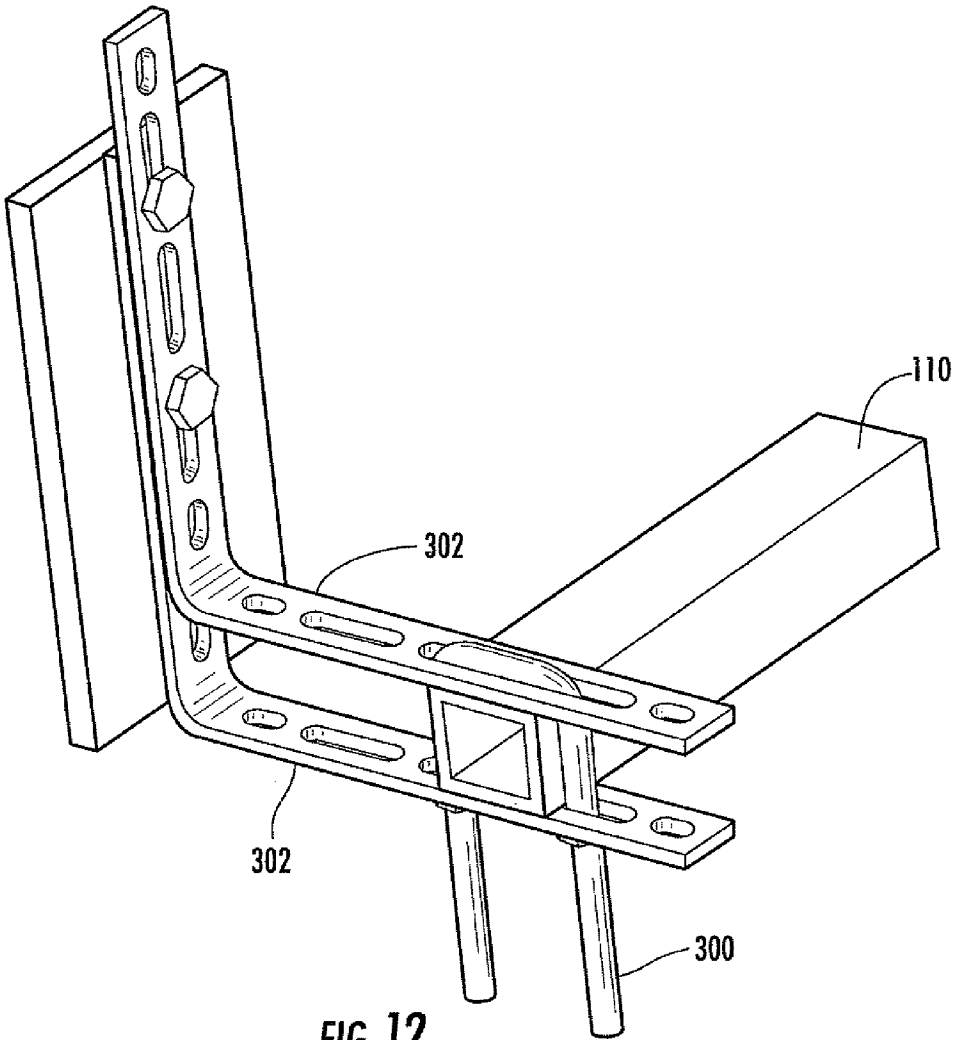
FIG. 12 shows a fourth technique for mounting the horizontal cross bar to the building.

FIG. 12 shows a forth technique for mounting the horizontal cross bar 110 to the building. This figure is like FIG. 11, except that both L brackets 302 are mounted on the same side of the mounting plate.

Figure 13:
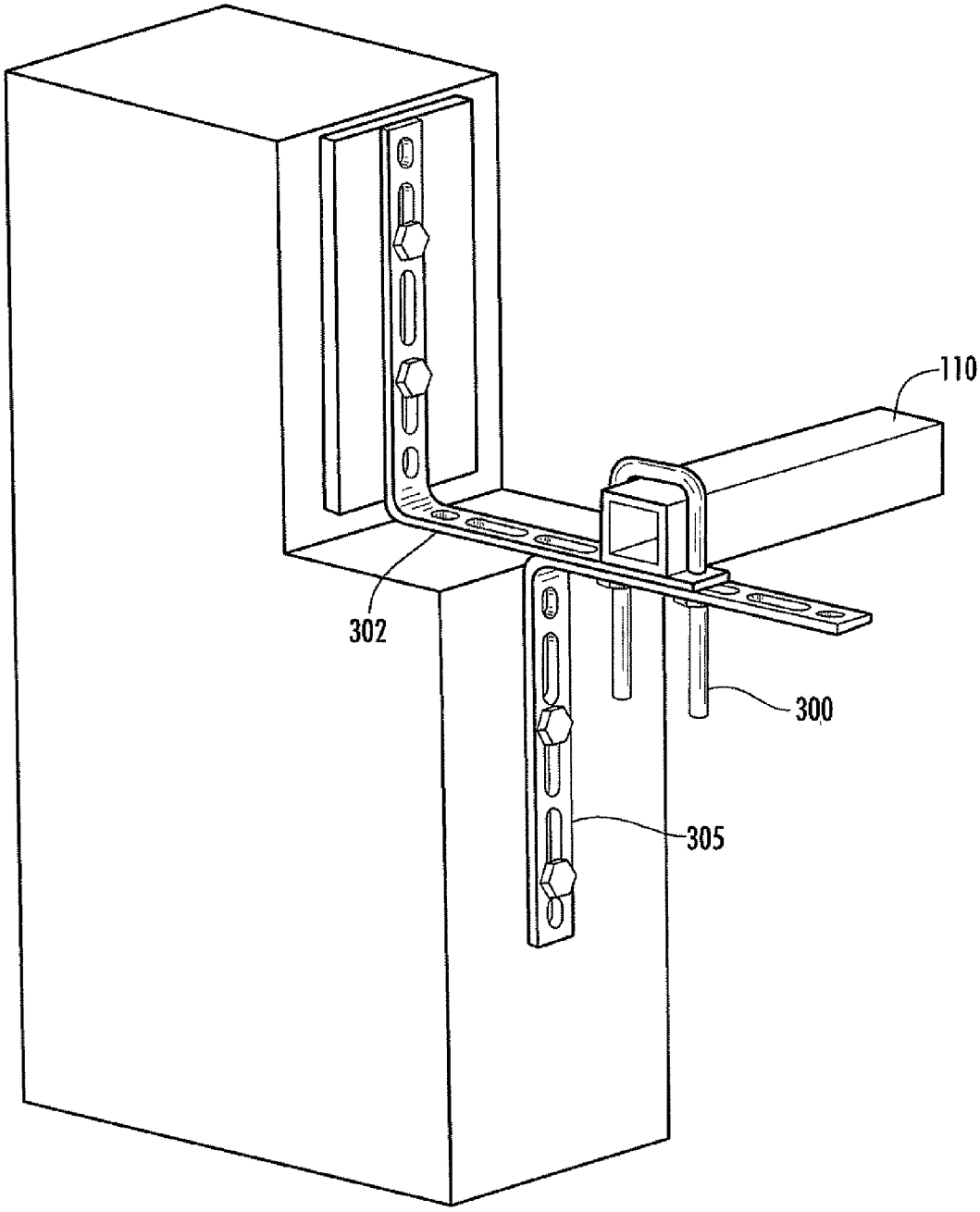
FIG. 13 shows a fifth technique for mounting the horizontal cross bar to the building.

FIG. 13 shows a fifth technique for mounting the horizontal cross bar 110 to the building. In this case, one L bracket 302 is utilized to mount to a plate against one portion of the building and a second L bracket 305, mounted below, accommodates the step nature of the building construction at the point of attachment.

Figure 14:
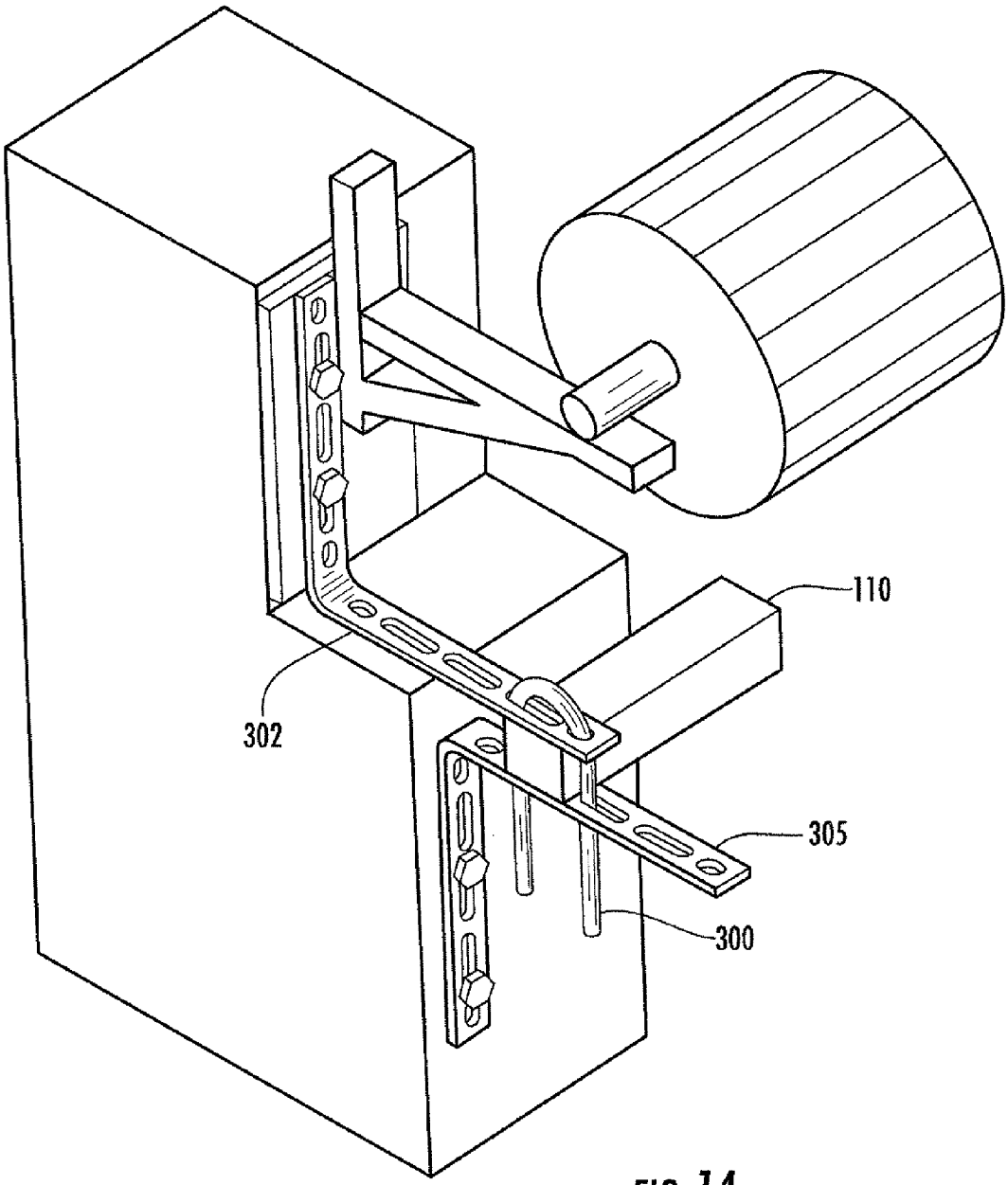
FIG. 14 shows a sixth technique for mounting the horizontal cross bar to the building.

FIG. 14 shows a sixth technique for mounting the horizontal cross bar 110 to the building. Again, there is a step displacement which can be utilized effectively by mounting two L brackets 302 and 305, one above and one below the cross bar position.

Figure 15:
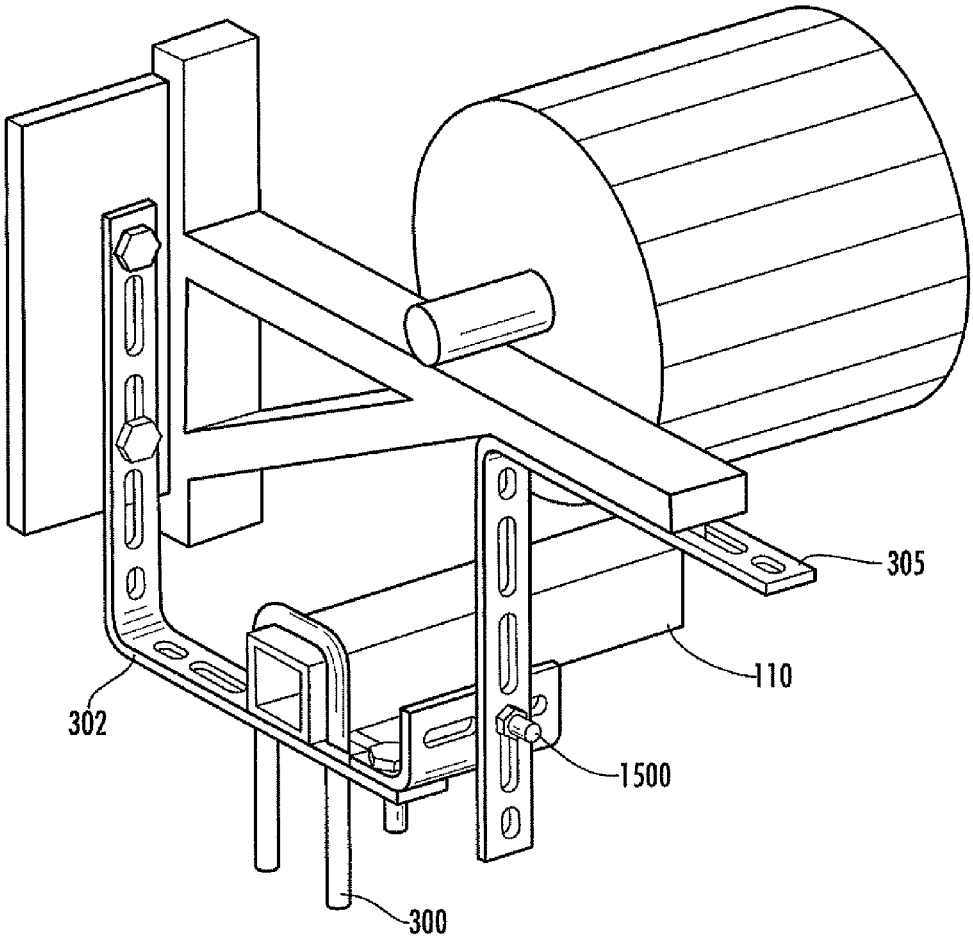
FIG. 15 shows a seventh technique for mounting the horizontal cross bar to the building.

FIG. 15 shows a seventh technique for mounting the horizontal cross bar 110 to the building. In this case, this technique is similar to that shown in FIG. 8 except that a small bracket 1500 is utilized to displace an L bracket 305 so that it can attach underneath the bracing to which the roll for the garage door panels is mounted. This allows yet added strength.

Figure 16:
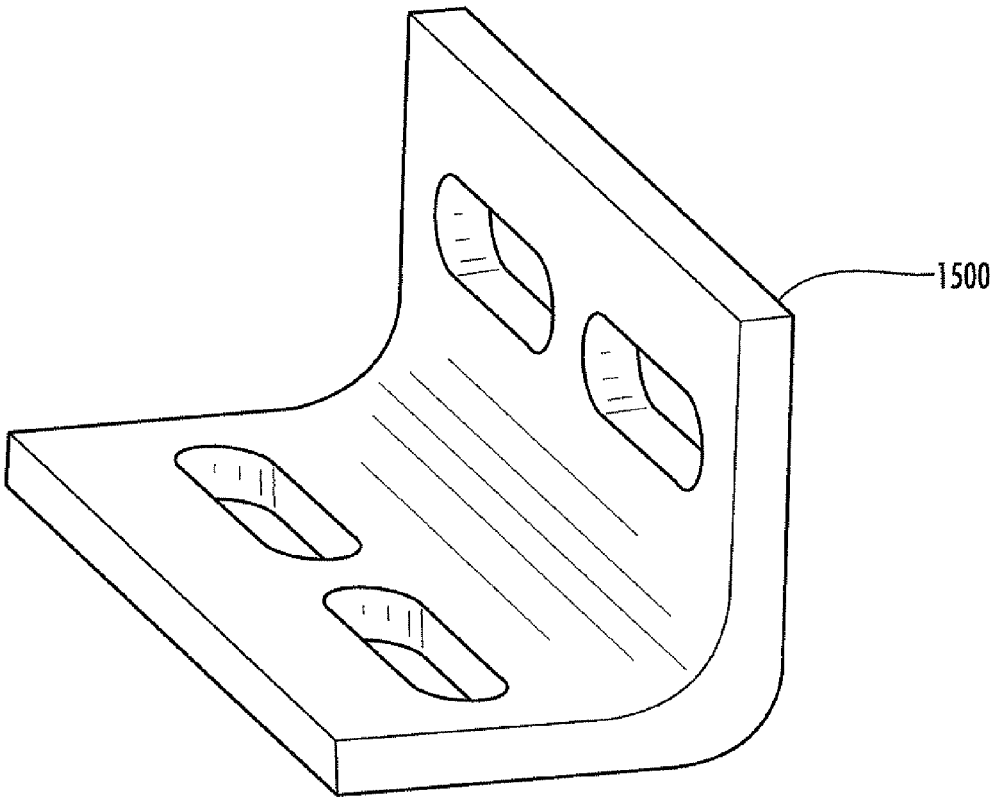
FIG. 16 is a perspective view of a small bracket used in the mounting arrangement of FIG. 15.

FIG. 16 is a perspective view of a small bracket 1500 used in the mounting arrangement of FIG. 15. Each of the techniques for mounting the horizontal cross bar to the building shown in FIGS. 8-15, utilize the same L bracket. That is, the construction of the L bracket is such as to accommodate a variety of configurations and mountings. This allows a single piece to have multiple uses and to reduce the number of pieces that might need to be stored or fabricated for an installation by homeowner in a do-it-yourself installation.

Figure 17:
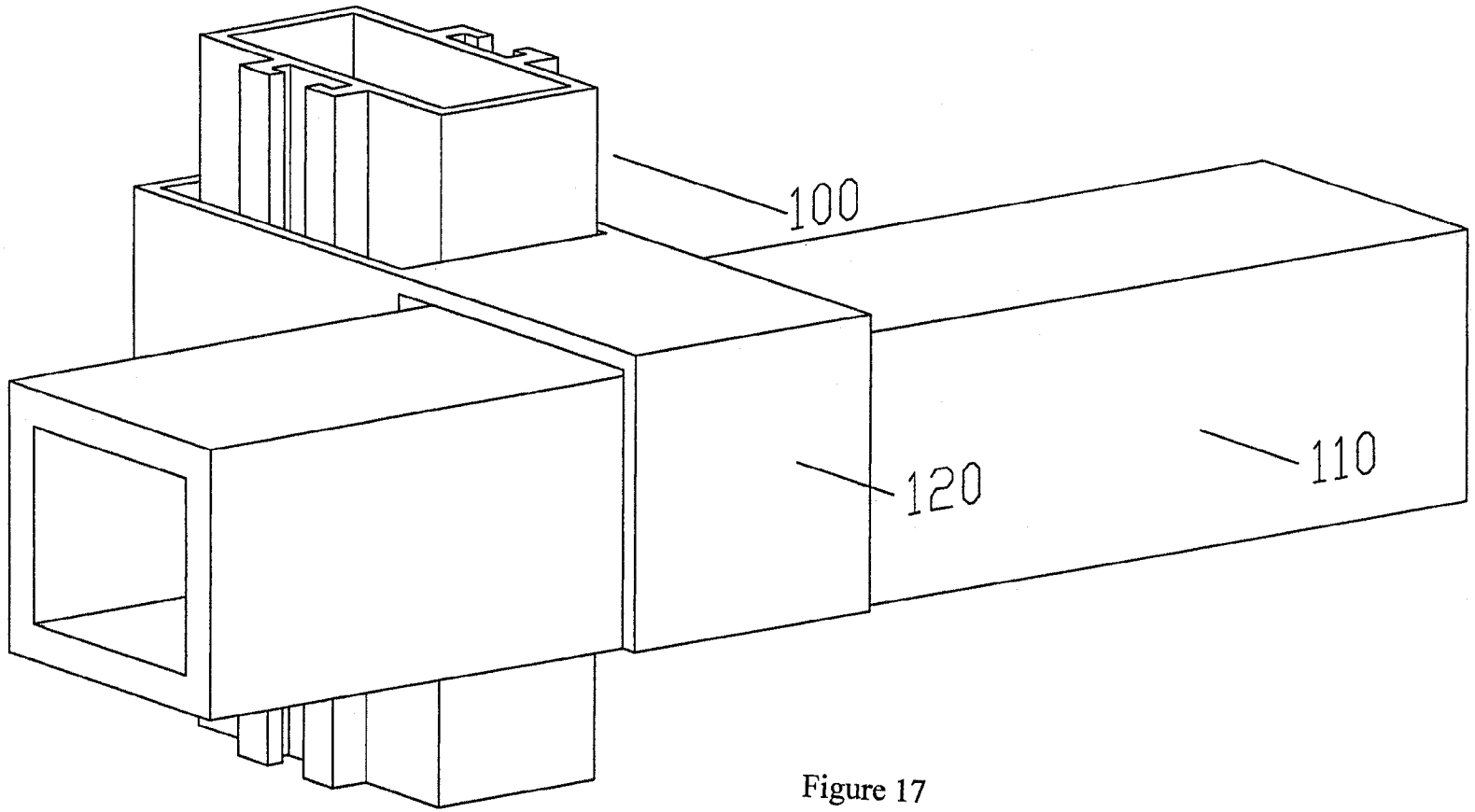
FIG. 17 is a perspective view of an assembly showing how to connect a vertical support to the horizontal cross bar shown in FIGS. 1A, 1B and 1C in accordance with one aspect of the invention.

FIG. 17 is a perspective view of an assembly showing how to connect a vertical support to the horizontal crossbar shown in FIGS. 1A, 1B and 1C.

Figure 18:
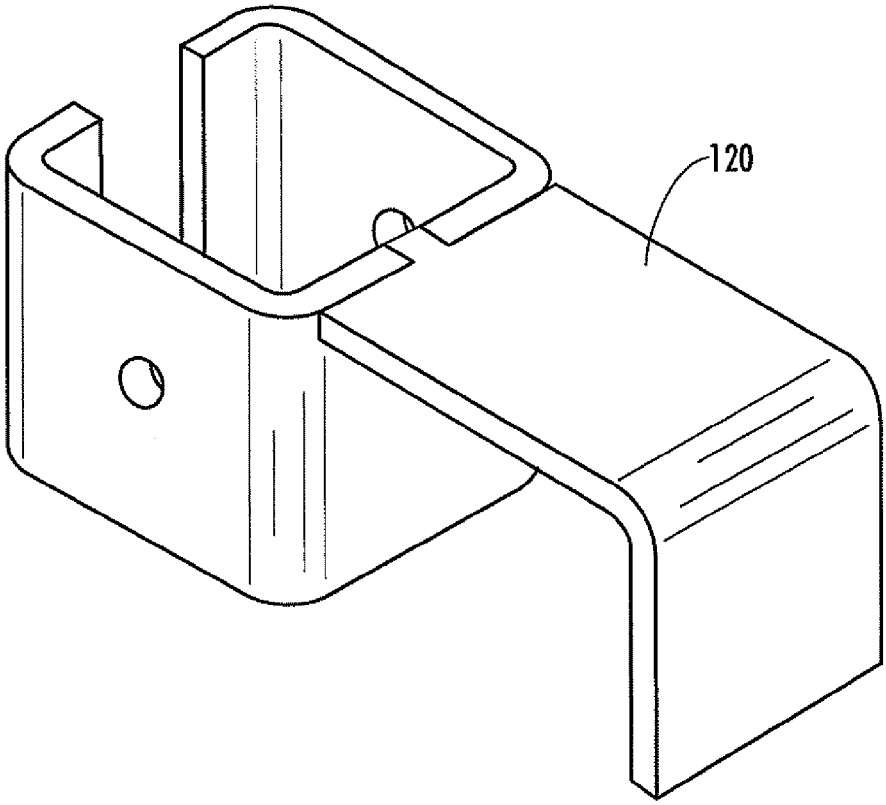
FIG. 18 is a perspective view of the bracket used in FIG. 17.

FIG. 18 provides a perspective view of the bracket 120 used in the attachment of FIG. 17.

Figure 19:
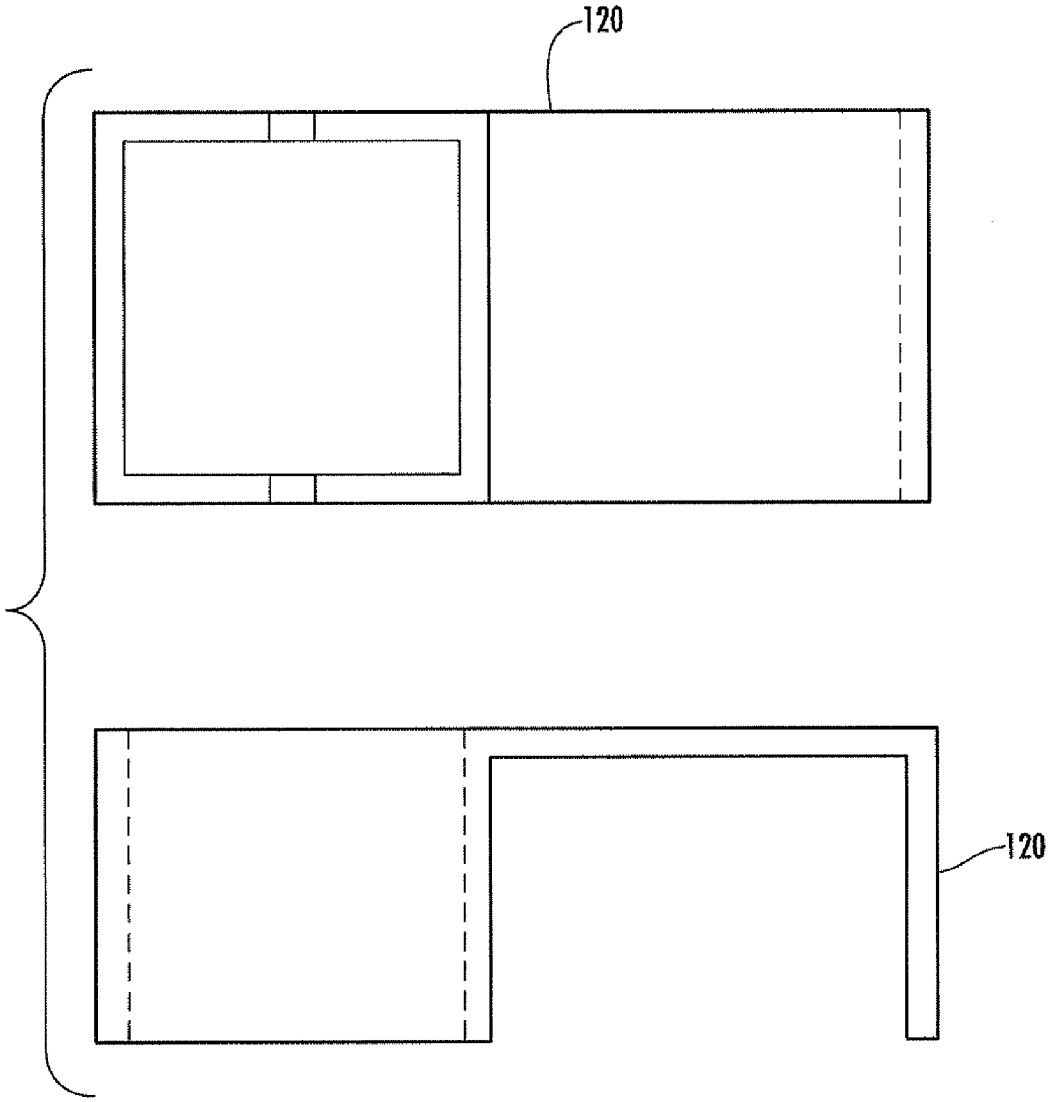
FIG. 19 is a detailed view of a preferred version of the bracket shown in FIG. 18.

FIG. 19 provides a detailed view of a preferred version of the bracket 120 shown in FIG. 17.

Returning to FIG. 17, one can see that the bracket and the mounting bolt locations are configured so that the head of the mounting bolts can slide in the T channels of the vertical support, allowing it to be adjustable up and down the vertical support.

Turning again to FIG. 1A, the vertical cross bar (s) the horizontal cross bar, the L brackets for mounting, the door mounting brackets 130 can be conveniently packed and shipped as a kit for easy installation by a homeowner, authorized dealer or contractor. Once installed, the vertical supports can be easily removed by disconnecting the hook from each of the door panel mounting brackets and by sliding the vertical brace 100 on crossbar 110 to either side of the horizontal bar to be secured to the side wall or by lifting the bracket 120 attached to the vertical support 100 so that the top of the bracket 120 clears the horizontal cross bar so that it can be removed and stored. The floor bracket is fastened to the vertical brace and moves with the vertical brace. Push rods can be used to slide into 2 predrilled holes thru a plate fastened in the floor. This plate will remain in the floor and can be driven over etc. Thus, with the L brackets and the cross bar in place, a homeowner can quickly and easily slide the rods into the floor bracket into previously drilled holes, connect or slide the vertical support(s) to or on the horizontal cross bar using bracket 120, adjust the channel slides to the corresponding heights of the U channels of the door mounting brackets and have a positive connection between the door panels and the vertical support bar that will protect the door against both positive and negative pressure. The sizing of the door mounting brackets are such that they can be accommodated in the roll up of the door panels when the door is open.

Figure 20:
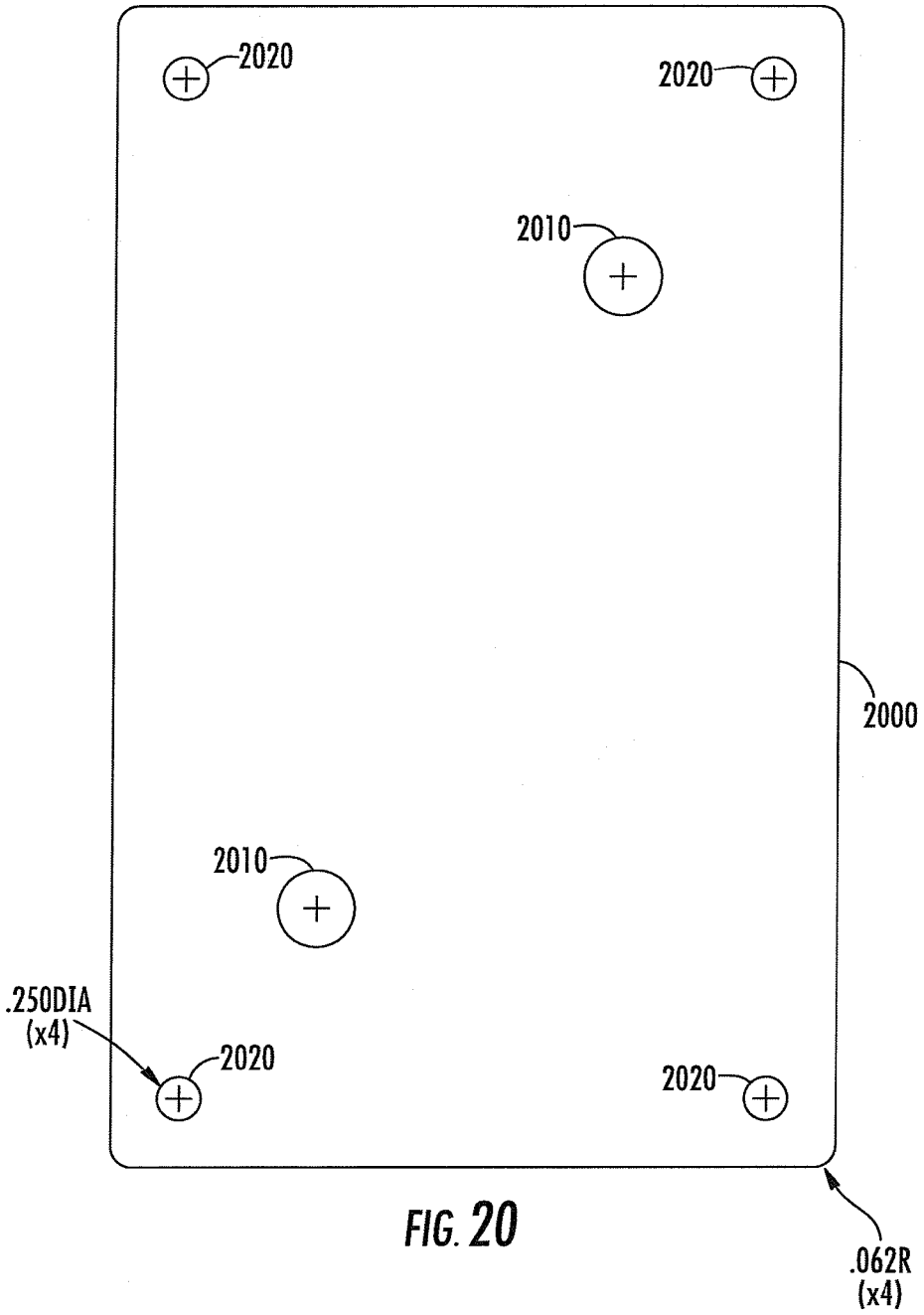
FIG. 20 is a base plate which cooperates to provide an improved floor mounting for a telescoping vertical member in accordance with one aspect of the invention.

FIG. 20 is a base plate which cooperates to provide an improved floor mounting for telescoping vertical member which provides bracing of garage doors against extreme forces in accordance with one aspect of the invention. The base plate 2000 is preferably made from galvanized steel of approximately 0.104 inches thickness.

The base plate has four holes 2020 which are utilized to bolt to the base plate to the floor where vertical member is to be mounted to reinforce a garage door. The base plate also has at least two holes 2010 which are use to receive the sliding bolt utilized to mount the vertical member to the base plate as described more hereinafter. Protective caps may be utilized to cover the holes 2010 in the base plate to keep material from entering through those holes into the hole in the driveway material beneath the base plate to keep the holes from filling with dirt and other material that might otherwise be captured by the holes, thus inhibiting the insertion of the sliding bolt assembly to its appropriate depth. The holes 2010 are designed to receive the sliding bolt from the sliding bolt assembly described hereinafter and to allow it to move in and out without being forced. Particular sizing of the holes can vary, depending on the materials to which the base plate is mounted.

Figure 21:
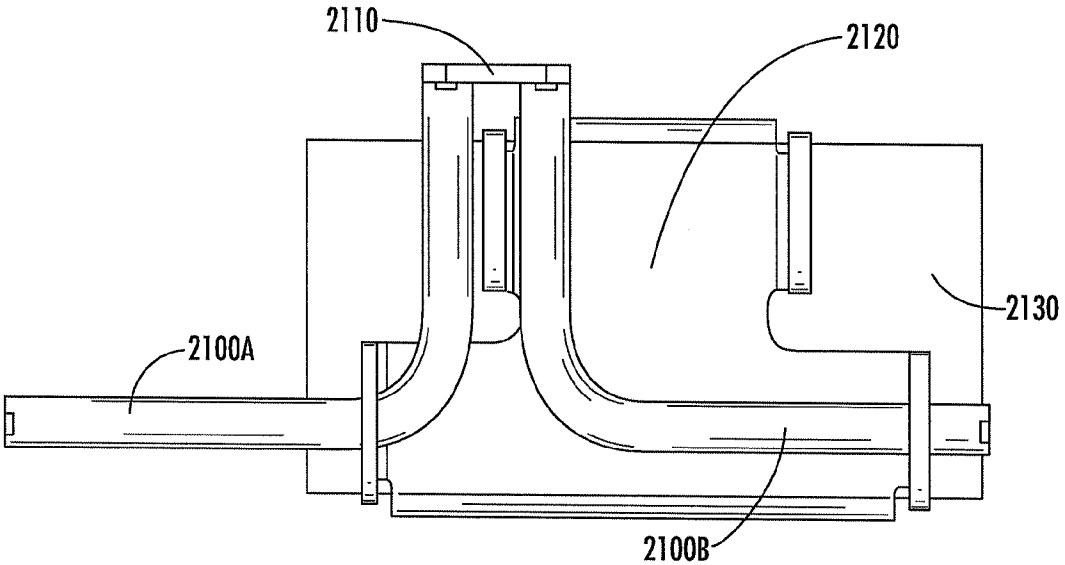
FIG. 21 is a side view of a sliding bolt assembly used in cooperation with the base plate of FIG. 20 for securing a vertical member to the floor of a garage door entrance in accordance with one aspect of the invention.

FIG. 21 is a side view of a sliding bolt assembly used in cooperation with the base plate of FIG. 20 for securing a vertical member to the floor of a garage door entrance in accordance with one aspect of the invention. In this view, one can see that two sliding bolts, 2100A and 2100B are positioned to slide through apertures in a sliding bolt assembly body 2120 which are perhaps more visible in later views. The two sliding bolts 2100A and 2100B are inserted through those apertures and affixed to a connecting bracket 2110 which is welded to both sliding bolts. The welding operation captures the sliding bolts between the two apertures through which the respective bolts slide. The sliding bolt assembly is shown positioned over a vertical member 2130 described more hereinafter.

Figure 22:
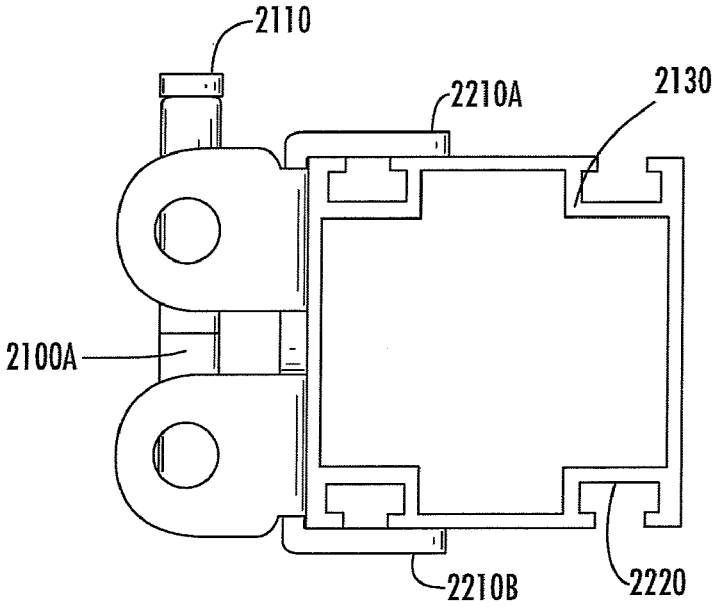
FIG. 22 is an end view of the sliding bolt assembly showing how it mounts to T channels of a vertical member in accordance with one aspect of the invention.

FIG. 22 is an end view of the sliding bolt assembly showing how it mounts to T channels of a vertical member in accordance with one aspect of the invention. As shown in the following perspective view, two tabs 2210A and 2210B are provided which partially surround the outer surface of the vertical member 2130. As can be seen in FIG. 22, the vertical member has a plurality of T channels 2220. Each of the tabs 2210A and 2210B has an opening which will accommodate a bolt. The two channels 2220 are sized to receive the head of such a bolt or a corresponding nut. In this instance, when the slide assembly body is placed as shown in FIG. 22, nuts are inserted in the T channel and slided to a position where they are substantially underneath the opening in the aperture 2210A and 2210B. A bolt is then fed through the opening in the apertures 2210A and 2210B and utilized to engage the nut in the T channel thus allowing the bolt and nut combinations to secure the sliding assembly body to the vertical member when the bolts and nuts are tightened.

Loosening of the bolt and nut assemblies permits the sliding bolt assembly body to change position along the length of the vertical member as desired.

Figure 23:
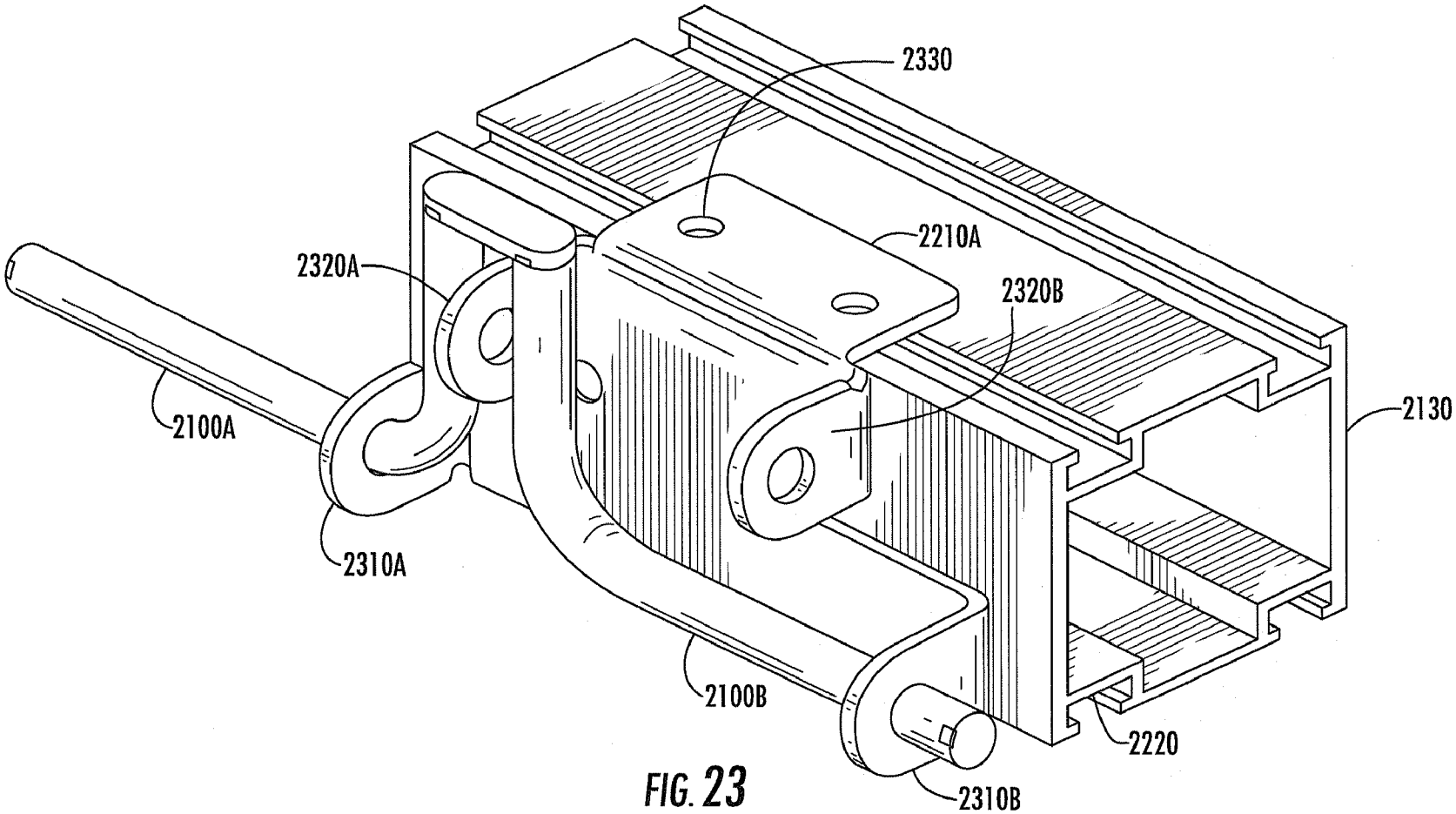
FIG. 23 is a perspective view of how the sliding bolt assembly relates to the bottom of the vertical member in accordance with one aspect of the invention.

FIG. 23 is a perspective view of how the sliding bolt assembly relates to the bottom of the vertical member. As shown in this view, top tab 2210A is positioned over one of the T channels 2220 in the vertical member. A corresponding tab 2210B (not shown) is positioned over an opposite T channel 2220. In this view, two nuts and potentially washers, are inserted in the end of the T channels and slided along the T channel until they are positioned respectively below the two openings such as 2330A are created in the tab 2210A prior to assembly to permit the threaded body of a bolt to pass through the opening 2330 to engage the nut and any optional washers riding in the T channel track. The bolts and engaged nut assembly can be secured down or loosened to respectively lock in place or permit movement of the sliding bolt assembly body along the T channel track of the vertical member. Note that in the position shown, the bottom end of sliding bolt 2100B is substantially in the plane of the bottom of the vertical member 2130. Also in the position shown, the tab joining the two sliding bolts 2100A and 2100B holds the sliding bolt assembly in position by capturing tab 2320A between the sliding bolts. It is clear that the sliding bolt assembly can be rotated so that the tab joining the two sliding bolts is out of engagement with the tab 2320A so that the sliding bolts can move in a direction that allows the end of sliding bolt 2100B to extend beyond the plane of the bottom of the vertical member 2130. The two tabs 2320A and 2320B permit the sliding bolt assembly to be held in either a retracted position (shown) or in an extended position (not shown) where the sliding bolt can engage the apertures 2010 in the base plate and the holes provided beneath the base plate for receiving the sliding bolts. A combination lock or other type of lock can be utilized by inserting the hasp of the lock through openings 2310A or 2310B to prevent the sliding bolt(s) from moving from the extended or retracted position.

Figure 24:
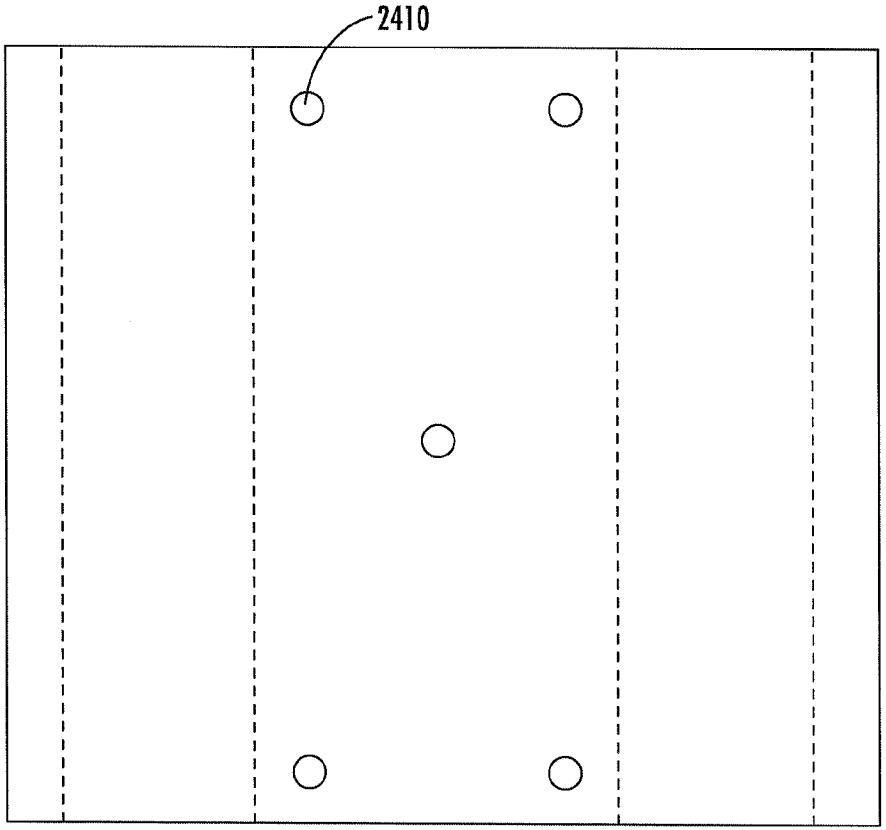
FIG. 24 is a top view of a building mounting bracket which cooperates to provide an improved building mount for securing the top portion of the vertical member to the building in accordance with one aspect of the invention.

FIG. 24 is a top view of a building mounting bracket which cooperates to provide an improved building mount for securing the top portion of a vertical member to the building in accordance with one aspect of the invention. In this view, one can see a plurality of mounting holes 2410 which are utilized to mount the mounting bracket to the building as described more hereinafter to facilitate connection of the vertical member to the building in a way in which the garage door can be reinforced.

Figure 25:
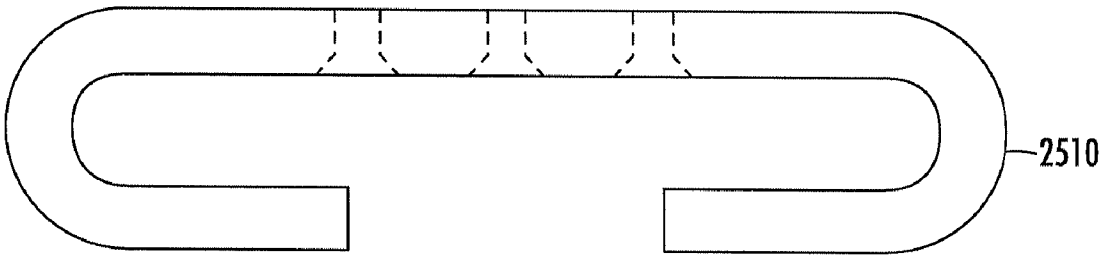
FIG. 25 is an end view of the building mounting bracket of FIG. 24.

FIG. 25 is an end view of the building mounting bracket of FIG. 24. The side of the holes 2410 are illustrated in invisible lines. The space identified with a typical measurement of 0.629 inches in one embodiment can vary, depending on the desired width of a mating part. That space actually receives a portion of a bracket for securing a vertical member to a building mounting bracket in that space. For that reason, it is preferred that the holes 2410 be countersunk so that head of bolts inserted through those holes 2410 lie flat with the inside surface of the bracket.

Figure 26:
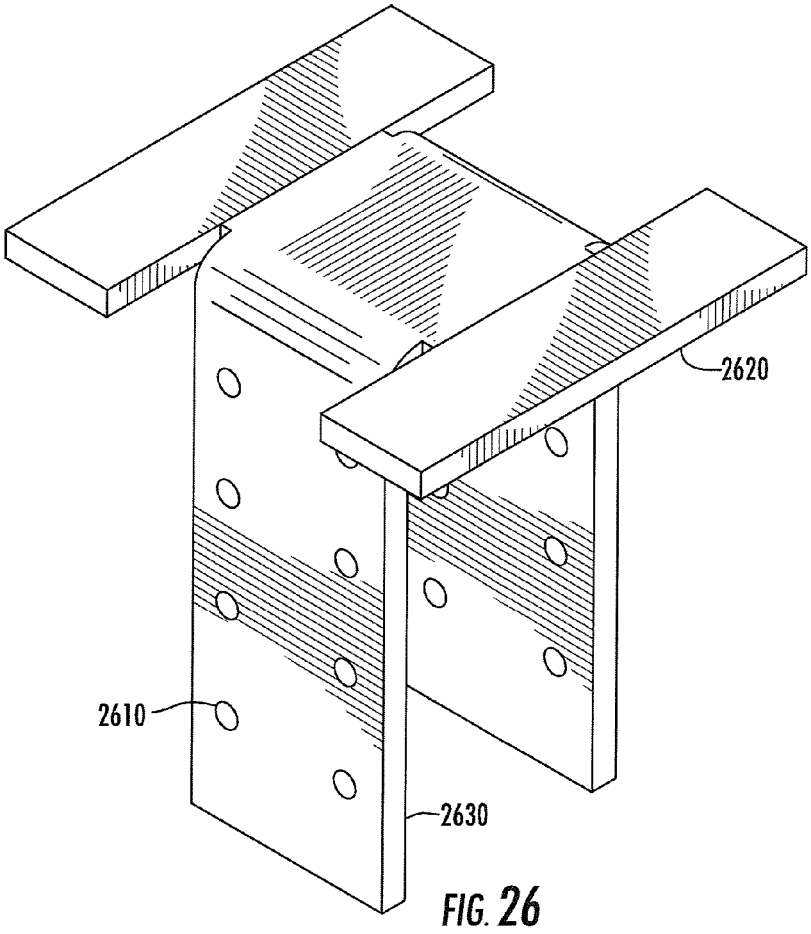
FIG. 26 is a perspective view of a bracket for securing a vertical member to a building mounting bracket.

FIG. 26 is a perspective view of the bracket for securing a vertical member to a building mounting bracket. The holes 2610 are provided a lower portion of the mounting bracket and enables bolts to be utilized to secure the mounting bracket to the vertical member, using the T track approach previously described. Note that the bracket used to connect to the mounting bracket can be mounted to the vertical member in two orientations as described more hereinafter. There is an upper portion of the mounting bracket 2620, which slidably engages with the building mounting bracket previously described. It is desirable that the thickness of the upper portion of the mounting bracket 2620 be thicker than that utilized in the portions which mount to the vertical member.

Figure 27A:
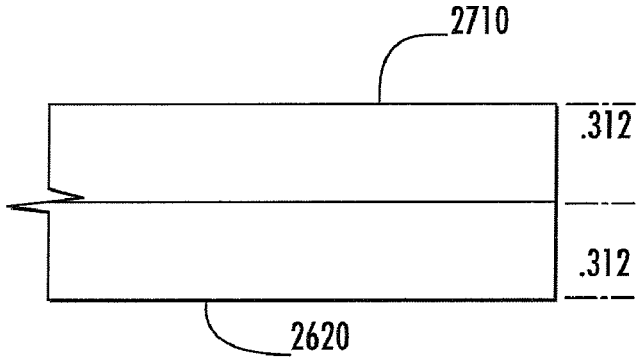
FIGS. 27A and 27B illustrate two alternative ways of enhancing the thickness of the slideable portion of the bracket of FIG. 26 to ensure a snug fit when that bracket is mated to the building mounting bracket.
Figure 27B:
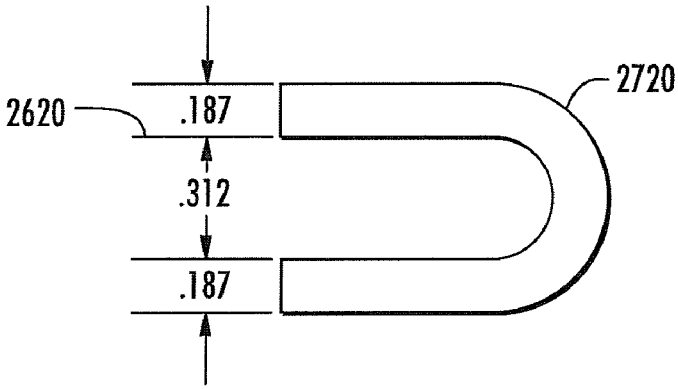

FIGS. 27A and 27B illustrate two alternative ways of enhancing the thickness of the slideable portion 2620 of the bracket of FIG. 26 to ensure a snug fit when that bracket is mated to the building mounting bracket. In FIG. 27A, a second piece of metal of the desired thickness, 2710, is attached to the slideable portion 2620. Such an attachment can occur by welding. Alternatively, slideable portion 2620 can be surrounded by a U shaped piece of metal 2720 which surrounds the outer edges of material 2620. This U shaped piece can also be welded to the portion 2620.

Figure 28:
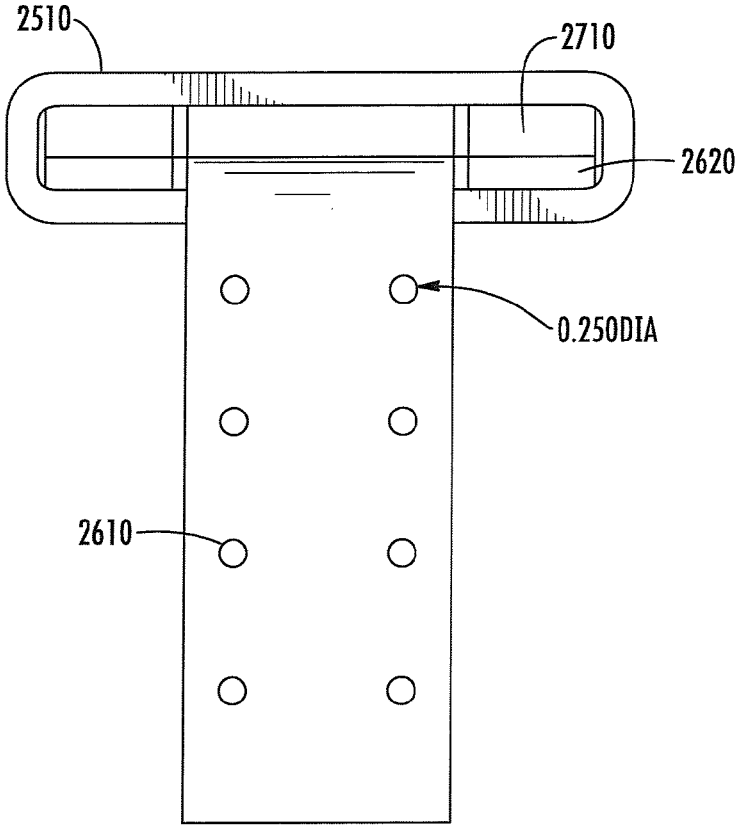
FIG. 28 is an end view of the bracket of FIG. 26 shown installed in the building mounting bracket.

FIG. 28 is an end view of the bracket of FIG. 26 shown installed in the building mounting bracket. As shown in FIG. 28, the thickness of the slideable portion of the bracket 2620 is enhanced with the addition of an additional thickness 2710 to ensure a snug fit as the slideable portion and its enhances thickness slide into the mounting bracket 2510. The holes 2610 are utilized to secure the bracket to the vertical member.

Figure 29:
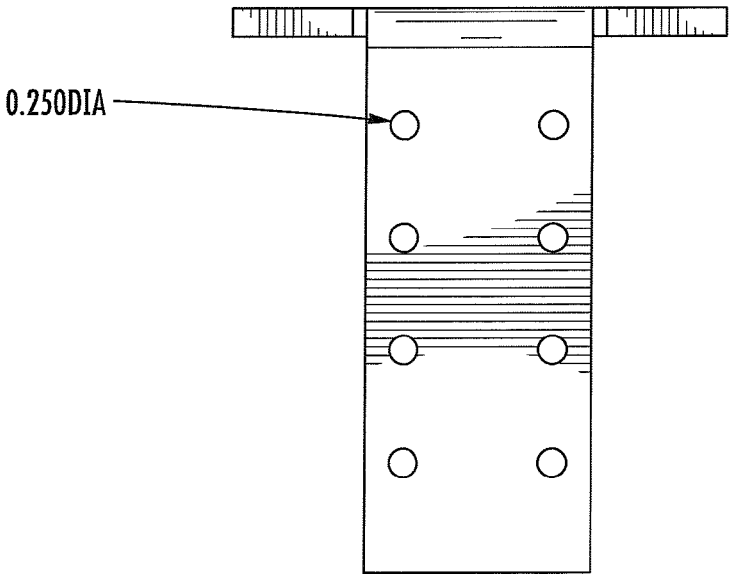
FIG. 29 is a side view of the bracket of FIG. 26 showing preferred dimensions for the holes for mounting the bracket to the vertical member.

FIG. 29 is a side view of the bracket of FIG. 26 showing preferred dimensions for the holes for mounting the bracket to the vertical member.

Figure 30:
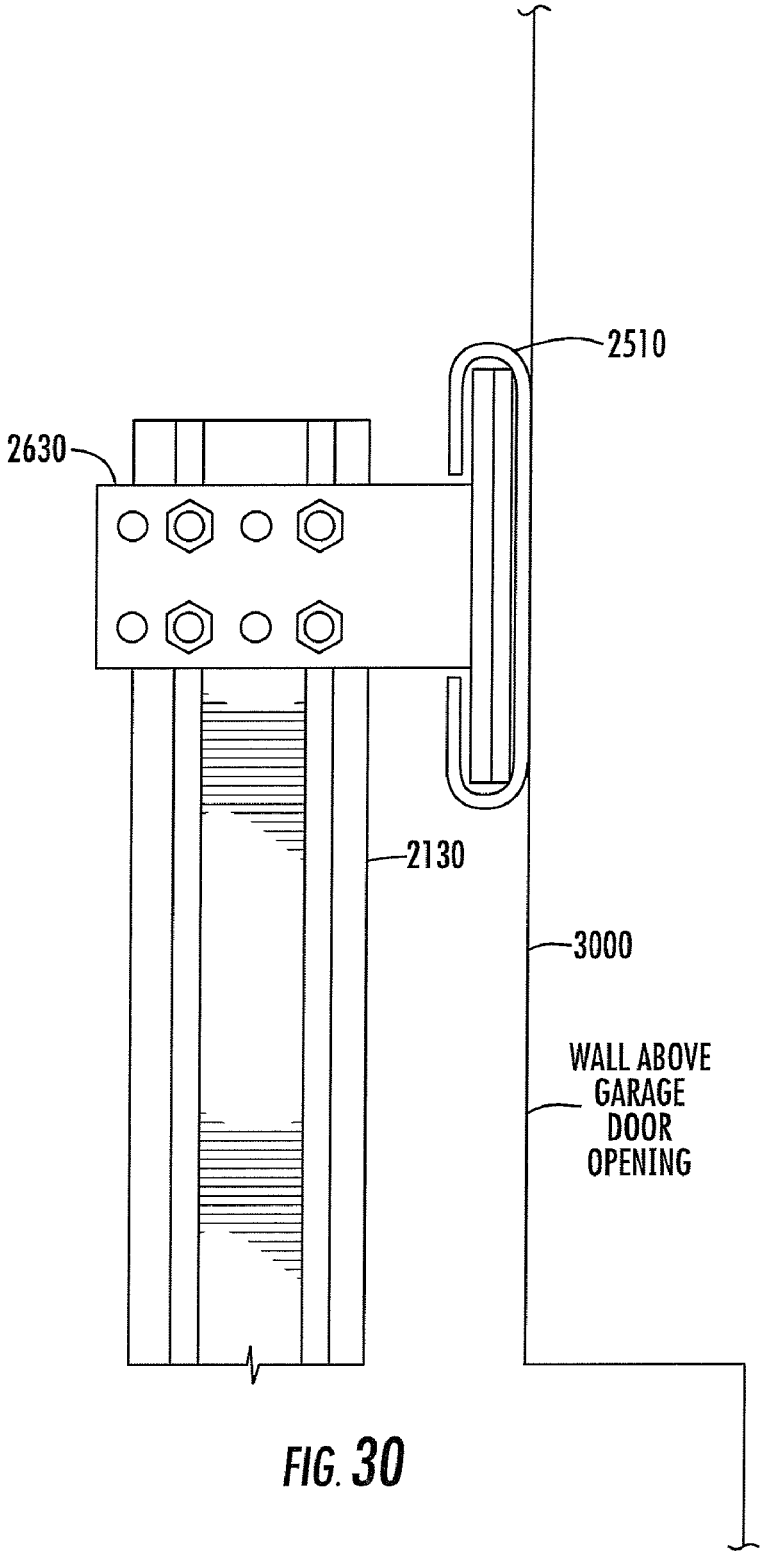
FIG. 30 illustrates one way of mounting a building mounting bracket to a building wall for securing a vertical member to the building with the bracket of FIG. 26 in accordance with one aspect of the invention.

FIG. 30 illustrates one way of mounting a building mounting bracket to a building wall for securing a vertical member to the building with the bracket of FIG. 26 in accordance with one aspect of the invention. As shown, the building mounting bracket 2510 is bolted to the wall above the garage door opening 3000. The mounting bracket 2630 is applied to the vertical member 2130 so as to permit the slideable portion of bracket 2630 to slide into the building mounting bracket as shown. In this configuration, both the building mounting bracket 2510 and the vertical member 2130 are parallel with the wall 3000 and perpendicular to the mounting bracket 2630 as shown.

Figure 31:
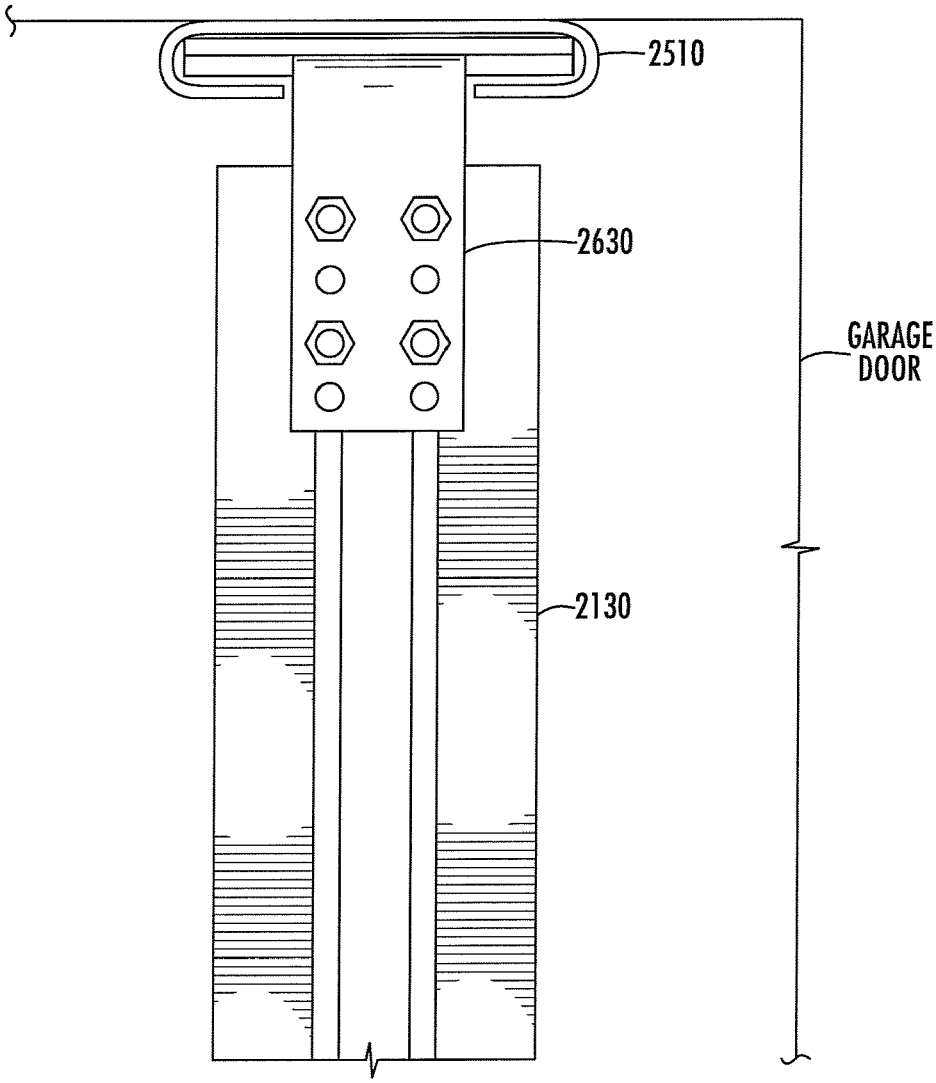
FIG. 31 illustrates one way to mount a building mounting bracket to a ceiling, or header above a garage door opening for securing a vertical member to the ceiling or header with a bracket of FIG. 26 in accordance with one aspect of the invention.

FIG. 31 illustrates one way to mount a building mounting bracket to a ceiling or header above a garage door opening for securing a vertical member to the ceiling or header with the bracket of FIG. 26 in accordance with one aspect of the invention. As shown in this Figure, the building mounting bracket 2510 is mounted to the ceiling or header above a garage door. The slideable bracket 2630 is mounted to the vertical member 2130 utilizing the T channels as described above. Once the bracket 2630 is mounted to the vertical member, and the positioning 2630 adjusted to be the correct height, the slideable portion, 2620, of the bracket can be slided into the building mounting bracket to provide a quick and easy mounting which will secure the vertical member to the building mounting bracket for use during a storm.

Once the base plate shown in FIG. 1 is mounted to the floor by the garage door, and the building mounting bracket is attached to either the ceiling, header or the wall above the garage door, the vertical member, with its installed sliding bolt assembly and its bracket for mounting to the building mounting bracket can be installed and removed in a very short period of time. Upon removal, it may be desirable to provide filler caps, such as rubber plugs, to prevent material from accumulating in holes 2010 of the base plate when the vertical members are stored for later usage.

Thus, installation of garage door protection requires only the permanent installation of a floor plate and a building mounting bracket. Both of these are unobtrusive and generally not noticeable when a vertical member is not in place. Nevertheless, when the vertical member with its mounting bracket and its sliding bolt assembly need to be positioned to protect the garage door during a storm, the sliding bolt assembly permits rapid installation of the base of the vertical member and the building mounting bracket permits a quick and slideable installation of the top end of the vertical member resulting in a strong and robust vertical member.

The attachment of the garage door itself to one or more vertical members can occur in the way previously described. The components needed to secure a garage door can be assembled in a kit form in which an outside kit might include:

a. a plurality of L brackets;
b. one horizontal cross bar;
c. at least one vertical support bar;
d. a floor mounting bracket; and
e. bracket for substantially surrounding a vertical support bar and for engaging said horizontal cross bar.

As noted previously, an inside kit can comprise the following items:

a. at least one vertical support;
b. a floor plate for each vertical support;
c. at least one sliding bolt assembly for mounting to each vertical support;
d. a mounting bracket for each vertical support for mounting to a building surface; and
e. a support bracket for attachment to each vertical support and for slidably engaging a mounting bracket.

The installation and the take down of the garage door protection can occur quickly and easily. The installation of a floor bracket and a wall or ceiling bracket can be done by a homeowner with limited building skill in a quick and reliable manner.

While various embodiments of the present invention have been illustrated herein in detail, it should be apparent that modifications and adaptations to those embodiments may occur to those skilled in the art without departing from the scope of the present invention as set forth in the following claims.

The invention claimed is:

1. An apparatus for bracing a roll down door of a building, the roll down door comprising a plurality of horizontally positioned door panels adjacent one another, the apparatus comprising:

at least one vertical support bar having a first end to be secured to the floor, and a second end;

a floor mount for securing the first end of said at least one vertical support bar to the floor;

a top mount assembly comprising a building mounting bracket having an elongated C-shaped configuration to be attached to the building and including a C-shaped receiving area therein, and a support bracket having a U-shaped configuration to be attached to the second end of said at least one vertical support bar, and comprising pair of spaced apart extensions extending outwardly therefrom to be received by the C-shaped receiving area of said building mounting bracket; and at least one attachment mechanism for connecting said at least one vertical support bar to at least one of the roll down door panels.

2. The apparatus of claim 1 wherein said floor mount comprises a plate with a plurality of openings for receiving mounting bolts for securing to the floor, and including at least one additional opening for receiving a sliding bolt.

3. The apparatus of claim 2 further comprising at least one sliding bolt assembly to be coupled to said at least one vertical support bar and comprising a sliding bolt that moves between a retracted position and an extended position, whereby said sliding bolt fits in the at least one additional opening in said plate when in the extended position, and permits removal of said at least one vertical support bar from said floor mount when in the retracted position.

4. The apparatus of claim 3 wherein said at least one vertical support bar includes at least one channel track extending along a length thereof; and wherein said sliding bolt assembly is coupled to said at least one vertical support bar via the at least one channel track.

5. The apparatus of claim 1 wherein said building mounting bracket includes a backside opposite a gap defining the C-shaped receiving area, and wherein the backside is to be mounted to the building.

6. The apparatus of claim 5 wherein the backside of said building mounting bracket is to be mounted to the building so that the backside is perpendicular to the floor and the C-shaped receiving area is adjacent a side of said at least one vertical support bar, and wherein the U-shaped configuration of said support bracket is to be mounted parallel to the floor.

7. The apparatus of claim 5 wherein the backside of said building mounting bracket is to be mounted to the building so that the backside is parallel to the floor and the C-shaped receiving area is adjacent an upper surface of said at least one vertical support bar, and wherein the U-shaped configuration of said support bracket is to be mounted perpendicular to the floor.

8. The apparatus of claim 1 wherein said at least one vertical support bar includes at least one channel track extending along a length thereof; and wherein said at least one attachment mechanism comprises:

a channel slide piece to be adjusted vertically in the at least one channel track of said at least one vertical support bar, a bracket assembly to be coupled to one of the door panels, and a hook having a rotatable end coupled to said channel slide piece, and a free end for engaging said bracket assembly.

9. The apparatus of claim 8 wherein said hook includes a plurality of adjustment openings extending therethrough along the rotatable end, and wherein said channel slide track further comprises a bolt for coupling the rotatable end of said hook to said channel slide track through a selected adjustment opening.

10. The apparatus of claim 8 wherein said bracket assembly includes a U-shaped channel for receiving the free end of said hook.

11. The apparatus of claim 8 wherein said bracket assembly comprises front and back pieces to be coupled together on opposite sides of the door panel.

12. The apparatus of claim 8 wherein said at least one vertical support bar comprises telescoping sections, with each section having a rectangular cross section and including the at least one channel track.

13. An apparatus for bracing a roll down door of a building, the roll down door comprising a plurality of horizontally positioned door panels adjacent one another, the apparatus comprising:

at least one vertical support bar having a first end to be secured to the floor, and a second end, said at least one vertical support bar including at least one channel track extending along a length thereof;

a floor mount for securing the first end of said at least one vertical support bar to the floor;

a top mount assembly comprising a building mounting bracket having an elongated C-shaped configuration to be attached to the building and including a C-shaped receiving area therein, and a support bracket having a U-shaped configuration to be attached to the second end of said at least one vertical support bar, and comprising a pair of spaced apart extensions extending outwardly therefrom to be received by the C-shaped receiving area of said building mounting bracket; and at least one attachment mechanism for connecting said at least one vertical support bar to at least one of the roll down door panels, and comprising a channel slide piece to be adjusted vertically in the at least one channel track of said at least one vertical support bar, a bracket assembly to be coupled to one of the door panels, and a hook having a rotatable end coupled to said channel slide piece, and a free end for engaging said bracket assembly.

14. The apparatus of claim 13 wherein said floor mount comprises a plate with a plurality of openings for receiving mounting bolts for securing to the floor, and including at least one additional opening for receiving a sliding bolt.

15. The apparatus of claim 14 further comprising at least one sliding bolt assembly to be coupled to said at least one vertical support bar and comprising a sliding bolt that moves between a retracted position and an extended position, whereby said sliding bolt fits in the at least one additional opening in said plate when in the extended position, and permits removal of said at least one vertical support bar from said floor mount when in the retracted position.

16. The apparatus of claim 15 wherein said sliding bolt assembly is coupled to said at least one vertical support bar via the at least one channel track.

17. The apparatus of claim 13 wherein said building mounting bracket includes a backside opposite a gap defining the C-shaped receiving area, and wherein the backside is to be mounted to the building.

18. The apparatus of claim 17 wherein the backside of said building mounting bracket is to be mounted to the building so that the backside is perpendicular to the floor and the C-shaped receiving area is adjacent a side of said at least one vertical support bar, and wherein the U-shaped configuration of said support bracket is to be mounted parallel to the floor.

19. The apparatus of claim 17 wherein the backside of said building mounting bracket is to be mounted to the building so that the backside is parallel to the floor and the C-shaped receiving area is adjacent an upper surface of said at least one vertical support bar, and wherein the U-shaped configuration of said support bracket is to be mounted perpendicular to the floor.

20. The apparatus of claim 13 wherein said hook includes a plurality of adjustment openings extending therethrough along the rotatable end, and wherein said channel slide track further comprises a bolt for coupling the rotatable end of said hook to said channel slide track through a selected adjustment opening.

21. The apparatus of claim 13 wherein said bracket assembly includes a U-shaped channel for receiving the free end of said hook.

22. The apparatus of claim 13 wherein said bracket assembly comprises front and back pieces to be coupled together on opposite sides of the door panel.

23. The apparatus of claim 13 wherein said at least one vertical support bar comprises telescoping sections, with each section having a rectangular cross section and including the at least one channel track.

24. A method for bracing a roll down door of a building, the roll down door comprising a plurality of horizontally positioned door panels adjacent one another, the method comprising:

providing at least one vertical support bar having a first end to be secured to the floor, and a second end;

providing a floor mount for securing the first end of the at least one vertical support bar to the floor;

providing a top mount assembly comprising a building mounting bracket having an elongated C-shaped configuration to be attached to the building and including a C-shaped receiving area therein, and a support bracket having a C-shaped configuration to be attached to the second end of the at least one vertical support bar, and comprising a pair of spaced apart extensions extending outwardly therefrom to be received by the C-shaped receiving area of the building mounting bracket; and providing at least one attachment mechanism for connecting the at least one vertical support bar to at least one of the roll down door panels.

25. The method of claim 24 wherein the floor mount comprises a plate with a plurality of openings for receiving mounting bolts for securing to the floor, and including at least one additional opening for receiving a sliding bolt.

26. The method of claim 25 further comprising coupling at least one sliding bolt assembly to the at least one vertical support bar, the at least one sliding bolt assembly comprising a sliding bolt that moves between a retracted position and an extended position, whereby the sliding bolt fits in the at least one additional opening in the plate when in the extended position, and permits removal of the at least one vertical support bar from the floor mount when in the retracted position.

27. The method of claim 26 wherein the at least one vertical support bar includes at least one channel track extending along a length thereof; and wherein the sliding bolt assembly is coupled to the at least one vertical support bar via the at least one channel track.

28. The method of claim 24 wherein the building mounting bracket includes a backside opposite a gap defining the C-shaped receiving area, and wherein the backside is to be mounted to the building.

29. The method of claim 28 wherein the backside of the building mounting bracket is to be mounted to the building so that the backside is perpendicular to the floor and the C-shaped receiving area is adjacent a side of the at least one vertical support bar, and wherein the U-shaped configuration of the support bracket is to be mounted parallel to the floor.

30. The method of claim 28 wherein the backside of the building mounting bracket is to be mounted to the building so that the backside is parallel to the floor and the C-shaped receiving area is adjacent an upper surface of the at least one vertical support bar, and wherein the U-shaped configuration of the support bracket is to be mounted perpendicular to the floor.

31. The method of claim 24 wherein the at least one vertical support bar includes at least one channel track extending along a length thereof; and wherein the at least one attachment mechanism comprises:

a channel slide piece to be adjusted vertically in the at least one channel track of the at least one vertical support bar, a bracket assembly to be coupled to one of the door panels, and a hook having a rotatable end coupled to the channel slide piece, and a free end for engaging the bracket assembly.

32. The method of claim 31 wherein the hook includes a plurality of adjustment openings extending therethrough along the rotatable end, and wherein the channel slide track further comprises a bolt for coupling the rotatable end of the hook to the channel slide track through a selected adjustment opening.

33. The method of claim 31 wherein the bracket assembly includes a U-shaped channel for receiving the free end of the hook.

34. The method of claim 31 wherein the bracket assembly comprises front and back pieces to be coupled together on opposite sides of the door panel.

35. The method of claim 31 wherein the at least one vertical support bar comprises telescoping sections, with each section having a rectangular cross section and including the at least one channel track.

* * * * *